US009915054B2

(12) United States Patent
Wu

(10) Patent No.: US 9,915,054 B2
(45) Date of Patent: Mar. 13, 2018

(54) SHOVEL CONTROL METHOD AND SHOVEL CONTROL DEVICE

(71) Applicant: SUMITOMO HEAVY INDUSTRIES, LTD., Tokyo (JP)

(72) Inventor: Chunnan Wu, Kanagawa (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 14/515,632

(22) Filed: Oct. 16, 2014

(65) Prior Publication Data

US 2015/0039189 A1 Feb. 5, 2015

Related U.S. Application Data

(63) Continuation of application No. PCT/JP2013/065509, filed on Jun. 4, 2013.

(30) Foreign Application Priority Data

Jun. 8, 2012 (JP) ..... 2012-131013

(51) Int. Cl.

| | |
|---|---|
| ***E02F 3/43*** | (2006.01) |
| ***E02F 9/20*** | (2006.01) |
| ***E02F 9/22*** | (2006.01) |

(52) U.S. Cl.

CPC ..... *E02F 3/435* (2013.01); *E02F 3/436* (2013.01); *E02F 3/437* (2013.01); *E02F 9/2004* (2013.01);

(Continued)

(58) Field of Classification Search

CPC ..... E02F 3/43; E02F 5/145; E02F 9/20; E02F 9/2004; E02F 9/2012; E02F 9/2029; E02F 9/2025; E02F 9/2008; E02F 3/00; E02F 3/28; E02F 3/30; E02F 3/307; E02F 3/32; E02F 3/283; E02F 3/34; E02F 3/3677; E02F 3/40; E02F 3/42; E02F 3/422; E02F 3/425; E02F 3/431–3/439; E02F 5/00; E02F 5/02; E02F 5/025; E02F 5/16;

(Continued)

(56) References Cited

U.S. PATENT DOCUMENTS 5,002,454 A * 3/1991 Hadank ..... E02F 3/437 180/333
5,160,239 A * 11/1992 Allen ..... E02F 3/437 172/4.5

(Continued)

FOREIGN PATENT DOCUMENTS

| | | |
|---|---|---|
| EP | 0650544 | 5/1995 |
| EP | 0902131 | 3/1999 |

(Continued)

OTHER PUBLICATIONS

International Search Report dated Aug. 13, 2013.

*Primary Examiner* — Thomas G Black
*Assistant Examiner* — Sara J Lewandroski
(74) *Attorney, Agent, or Firm* — IPUSA, PLLC

(57) ABSTRACT

A shovel control method includes performing a plane position control or a height control of an end attachment by an operation of one lever. The plane position control is performed while maintaining a height of the end attachment. The height control is performed while maintaining a plane position of the end attachment.

10 Claims, 16 Drawing Sheets

(52) U.S. Cl.
CPC ..... *E02F 9/2012* (2013.01); *E02F 9/2075* (2013.01); *E02F 9/2285* (2013.01); *E02F 9/2296* (2013.01)

(58) Field of Classification Search
CPC ..... E02F 1/00; E02F 9/2045; E02F 9/2041; E02F 9/22; E02F 9/2203; E02F 9/26; E02F 9/261; E02F 9/262; E02F 9/264; E02F 9/265
USPC ..... 701/50
See application file for complete search history.

(56) References Cited

U.S. PATENT DOCUMENTS 5,178,510 A 1/1993 Hanamoto et al.
5,424,623 A * 6/1995 Allen ..... B25J 9/162 180/324
5,704,429 A * 1/1998 Lee ..... E02F 9/2004 172/4.5
6,025,686 A * 2/2000 Wickert ..... E02F 3/435 318/568.18
2002/0116921 A1* 8/2002 Shimokakiuchi ..... E02F 9/123 60/425
2008/0041805 A1* 2/2008 Jantti ..... E02F 3/436 212/270
2010/0254793 A1* 10/2010 Trifunovic ..... E02F 3/432 414/700
2011/0153167 A1* 6/2011 Kahle ..... E02F 3/32 701/50
2011/0318157 A1* 12/2011 Okamura ..... E02F 3/436 414/687
2012/0000192 A1* 1/2012 Ramun ..... E02F 3/301 60/427
2012/0065847 A1* 3/2012 Hobenshield ..... E02F 9/2004 701/50
2012/0323451 A1* 12/2012 Shatters ..... E02F 3/432 701/50
2013/0180744 A1* 7/2013 Favreau ..... E02F 3/7668 172/780

FOREIGN PATENT DOCUMENTS

JP S55-030038 3/1980
JP S60-152733 8/1985
JP S62-160327 7/1987
JP H9-287165 A * 4/1996 ..... E02F 3/43
JP H08-277543 10/1996
JP H09-287165 11/1997
JP H10-292417 11/1998
JP 2000-064336 2/2000

* cited by examiner

SHOVEL CONTROL METHOD AND SHOVEL CONTROL DEVICE

CROSS-REFERENCE TO RELATED APPLICATIONS

The present application is a continuation application filed under 35 U.S.C. 111(a) claiming benefit under 35 U.S.C. 120 and 365(c) of PCT International Application No. PCT/JP2013/065509 filed on Jun. 4, 2013, designating the U.S., which claims priority based on Japanese Patent Application No. 2012-131013 filed on Jun. 8, 2012. The entire contents of each of the foregoing applications are incorporated herein by reference.

BACKGROUND

Technical Field

The present invention relates to a shovel control method and a shovel control device.

Description of Related Art

Conventionally, there is known an excavation locus control device of a hydraulic shovel that enables a leveling and grading operation to be performed easily.

This excavation locus control device sets a work permission area horizontally extending in an extending direction of a front attachment of a hydraulic shovel and permits, when an axial center position of an arm end pin is within the work permission area, operations of an arm and a boom. On the other hand, this excavation locus control device sets a work suppression area around the work permission area and prohibits, when the axial center position of the arm end pin enters the work suppression area, any operation of arm draw, boom up and boom down.

In this way, the excavation locus control device permits an operator to easily perform a straight drawing operation along an extending direction of a front attachment and a leveling and grading operation.

SUMMARY

There is provided according to an aspect of the invention a shovel control method including performing a plane position control or a height control of an end attachment by an operation of one lever. The plane position control is performed while maintaining a height of the end attachment. The height control is performed while maintaining a plane position of the end attachment.

There is provided according to another aspect of the invention a shovel control device including a controller that performs a plane position control or a height control of an end attachment by an operation of one lever. The plane position control is performed while maintaining a height of the end attachment. The height control is performed while maintaining a plane position of the end attachment.

DETAILED DESCRIPTION

According to a hydraulic shovel equipped with the above-mentioned excavation locus control device, an operator uses individual operation levers corresponding to respective operations when operating an arm and a boom. Thus, the operator must operate simultaneously two operation levers when moving a bucket in the straight drawing operation or the leveling and grading operation. Thus, the straight drawing operation and the leveling and grading operation are still difficult operations for an operator who is inexperienced in operating a hydraulic shovel, and, a support to such an operator is not sufficient. Thus, it is preferable to provide a shovel control method and a shovel control device that enables an easier operation of a front attachment including, for example, a boom, arm and bucket.

A description will now be given, with reference to the drawings, of embodiments according to the present invention.

Figure 1:
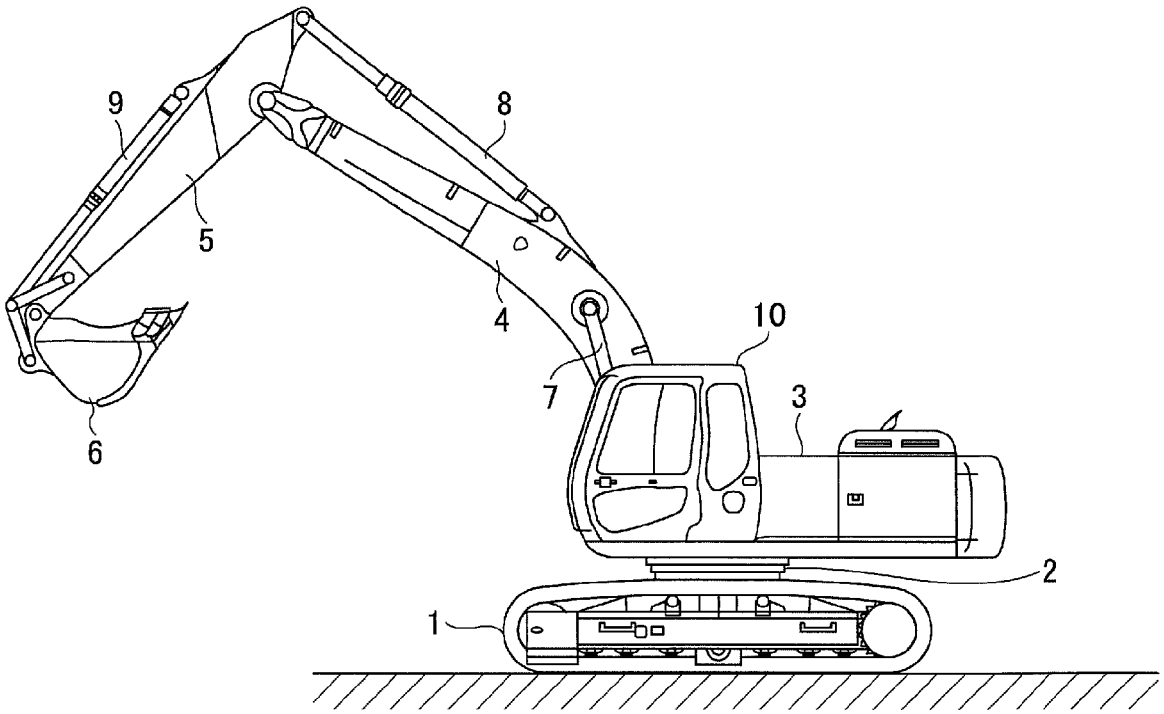
FIG. 1 is a side view illustrating a hydraulic shovel that performs a control method according to an embodiment of the preset invention.

FIG. 1 is a side view of a hydraulic shovel that performs a control method according to an embodiment of the present invention.

A lower running body 1 of the hydraulic shovel is mounted with an upper turning body 3 via a turning mechanism 2. A boom 4 as an operating body is attached to the upper turning body 3. An arm 5 as an operating body is attached to an end of the boom 4, and a bucket 6 as an operating body, which is an end attachment, is attached to an end of the arm 5. The boom 4, arm 5 and bucket 6 constitute a front attachment, and are hydraulically driven by a boom cylinder 7, arm cylinder 8 and bucket cylinder 9, respectively. The upper turning body 3 is provided with a cabin 10, and also mounted with a power source such as an engine or the like.

Figure 2:
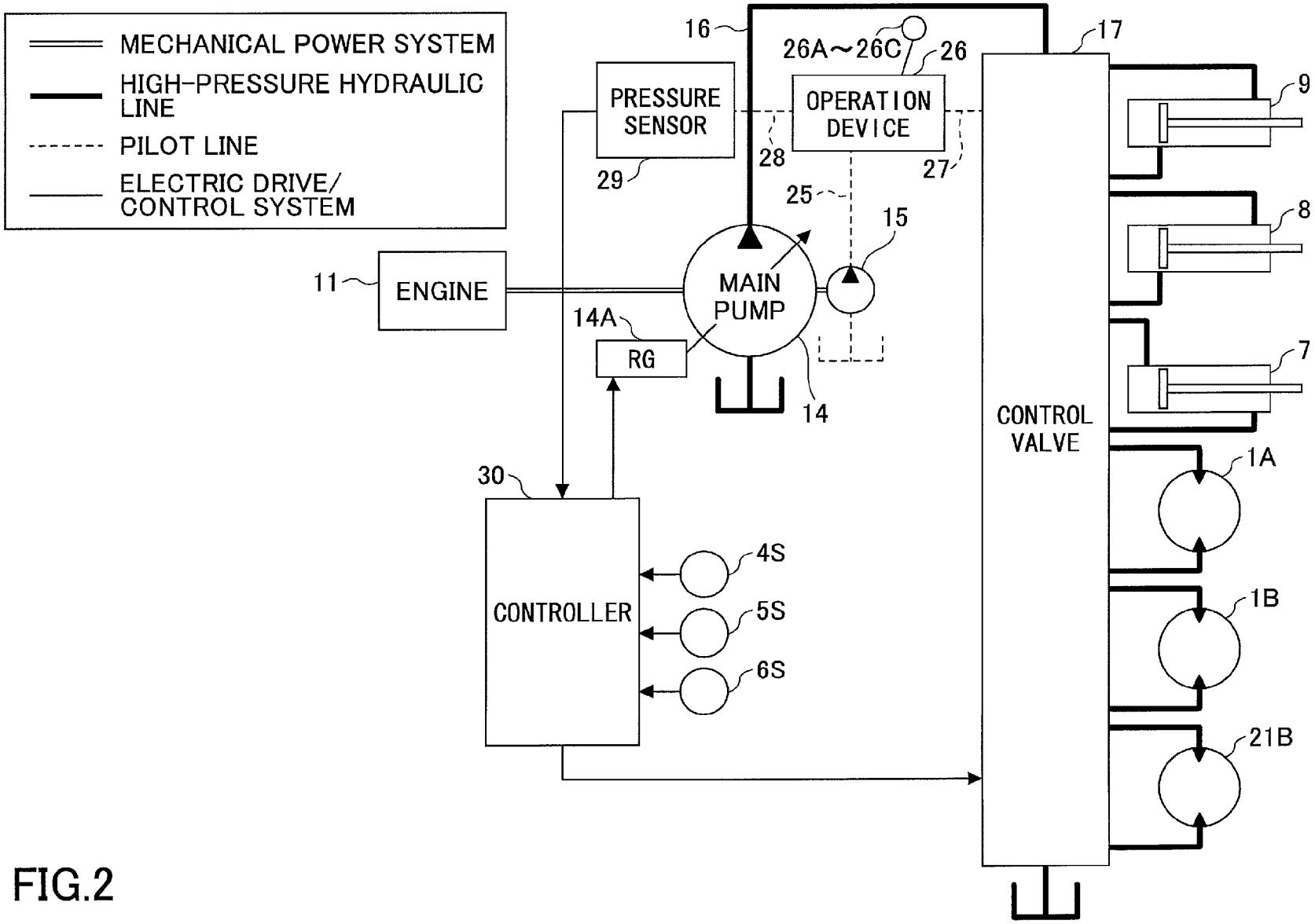
FIG. 2 is a block diagram illustrating a structural example of a drive system of the hydraulic shovel.

FIG. 2 is a block diagram illustrating a structural example of a drive system of the hydraulic shovel illustrated in FIG. 1. In FIG. 2, double solid lines denote a mechanical power system, bold solid lines denote high-pressure hydraulic lines, dashed thin lines denote pilot lines, and dotted thin lines denote an electric drive/control system.

A main pump 14 and pilot pump 15 as hydraulic pumps are connected to an output axis of an engine 11 as a mechanical drive part. The main pump 14 is connected with a control valve 17 via a high-pressure hydraulic line 16. The main pump 14 is a variable capacity hydraulic pump of which a discharged amount of flow per one pump revolution is controlled by a regulator 14A.

The control valve 17 is a hydraulic control device for performing a control of a hydraulic system in the hydraulic shovel. Hydraulic motors 1A (right) and 1B (left) for the lower running body 1, the boom cylinder 7, arm cylinder 8 and bucket cylinder 9 are connected to the control valve 17 via high-pressure hydraulic lines. The pilot pump 15 is connected with an operation device 26 via a pilot line 25.

The operation device 26 includes a lever 26A, lever 26B and pedal 26C. The lever 26A, lever 26B and pedal 26C are connected to the control valve 17 and a pressure sensor 29 via hydraulic lines 27 and 28, respectively. The pressure sensor 29 is connected to a controller 30, which performs a drive control of an electric system.

In the present embodiment, an attitude or posture sensor for detecting an attitude or posture of each operating body is attached to each operating body. Specifically, a boom angle sensor 4S for detecting an inclination angle of the boom 4 is attached to a support axis of the boom 4. An arm angle sensor 5S for detecting an open/close angle of the arm 5 is attached to a support axis of the arm 5. A bucket angle sensor 6S for detecting an open/close angle of the bucket 6 is attached to a support axis of the bucket 6. The boom angle sensor 4S supplies a detected boom angle to the controller 30. The arm angle sensor 5S supplies a detected arm angle to the controller 30. The bucket angle sensor 6S supplies a detected bucket angle to the controller 30.

The controller 30 is a shovel control device as a main control part for performing a drive control of the hydraulic shovel. The controller 30 is configured by an operation processing device including a CPU (Central Processing Unit) and an internal memory, and is a device materialized by the CPU executing a drive control program stored in the internal memory.

Figure 3A:
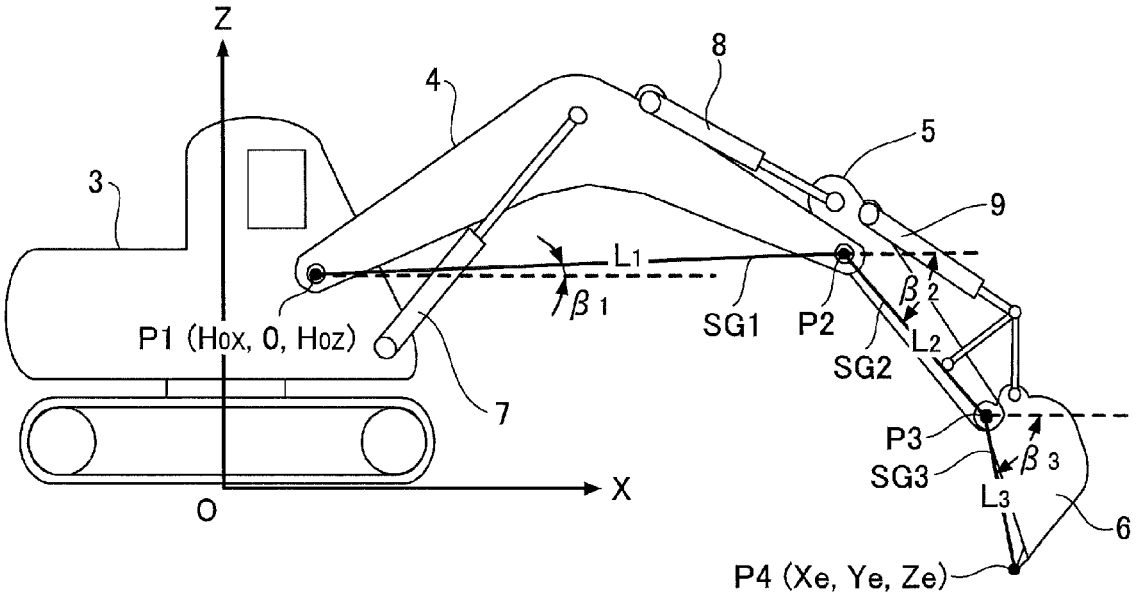
FIG. 3A is a side view of the hydraulic shovel for explaining a three-dimensional orthogonal coordinate system used in the control method.
Figure 3B:
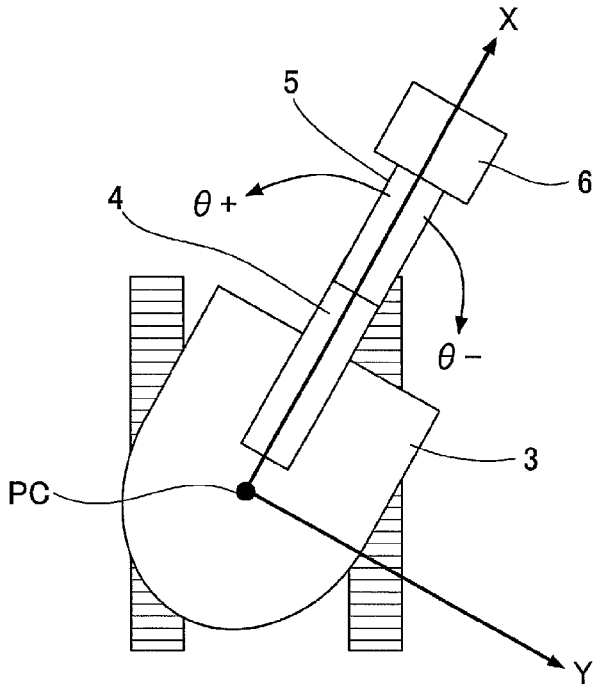
FIG. 3B is a plane view of the hydraulic shovel for explaining the three-dimensional orthogonal coordinate system used in the control method.

Next, a description is given, with reference to FIGS. 3A and 3B, of a three-dimensional orthogonal coordinate system used in the control method according to the embodiment of the present invention. FIG. 3A is a side view of the hydraulic shovel, and FIG. 3B is a top view of the hydraulic shovel.

As illustrated in FIGS. 3A and 3B, the Z-axis of the three-dimensional orthogonal coordinate system corresponds to a turning axis PC of the hydraulic shovel, the original point O of the three-dimensional orthogonal coordinate system corresponds to an intersection of the turning axis PC and an installation surface of the hydraulic shovel.

Moreover, the X-axis orthogonal to the Z-axis extends in an extending direction of the front attachment, and the Y-axis orthogonal to the Z-axis extends in a direction perpendicular to an extending direction of the front attachment. That is, the X-axis and the Y-axis rotate about the Z-axis with turning of the hydraulic shove. It should be noted that, in a turning angle θ of the hydraulic shovel, a counterclockwise direction with respect to the X-axis is set to a plus direction in the top view as illustrated in FIG. 3B.

Moreover, as illustrated in FIG. 3A, an attaching position of the boom 4 with respect to the upper turning body 3 is represented by a boom pin position P1, which is a position of a boom pin as a boom rotation axis. Similarly, an attaching position of the arm 5 with respect to the boom 4 is represented by an arm pin position P2, which is a position of an arm pin as an arm rotation axis. Additionally, an attaching position of the bucket 6 with respect to the arm 5 is represented by a bucket pin position P3, which is a position of a bucket pin as a bucket rotation axis. Further, an end position of the bucket 6 is represented by a bucket end position P4.

Moreover, a length of a line segment SG1 connecting the boom pin position P1 and the arm pin position P2 is represented by a predetermined value $L_1$ as a boom length. A length of a line segment SG2 connecting the arm pin position P2 and the bucket pin position P3 is represented by a predetermined value $L_2$ as an arm length. A length of a line segment SG3 connecting the bucket pin position P3 and the bucket end position P4 is represented by a predetermined value $L_3$ as a bucket length.

An angle formed between the line segment SG1 and a horizontal plane is represented by a ground angle $\beta_1$. An angle formed between the line segment SG2 and a horizontal plane is represented by a ground angle $\beta_2$. An angle formed between the line segment SG3 and a horizontal plane is represented by a ground angle $\beta_3$. Hereinafter, the ground angles $\beta_1$, $\beta_2$ and $\beta_3$ may be referred to as the boom rotation angle, arm rotation angle, and bucket rotation angle, respectively.

Here, on the assumption that a three-dimensional coordinate of the boom pin position P1 is represented by (X, Y, Z)=($H_{0X}$, 0, $H_{0Z}$) and a three-dimensional coordinate of the bucket end position P4 is represented by (X, Y, Z)=(Xe, Ye, Ze), Xe and Ze are represented by formulas (1) and (2), respectively.

$$Xe=H_{0X}+L_1\cos\beta_1+L_2\cos\beta_2+L_3\cos\beta_3 \quad (1)$$

$$Ze=H_{0Z}+L_1\sin\beta_1+L_2\sin\beta_2+L_3\sin\beta_3 \quad (2)$$

It should be noted that Ye is zero because the bucket end position P4 lies on the XZ-plane.

Moreover, because the coordinate value of the boom pin position P1 is a fixed value, if the ground angles $\beta_1$, $\beta_2$ and $\beta_3$ are determined, the coordinate value of the bucket end position P4 is uniquely determined. Similarly, if the ground angles $\beta_1$, is determined, the coordinate value of the arm pin position P2 is uniquely determined, and if the ground angles $\beta_1$ and $\beta_2$ are determined, the coordinate value of the bucket pin position P3 is uniquely determined.

Figure 4:
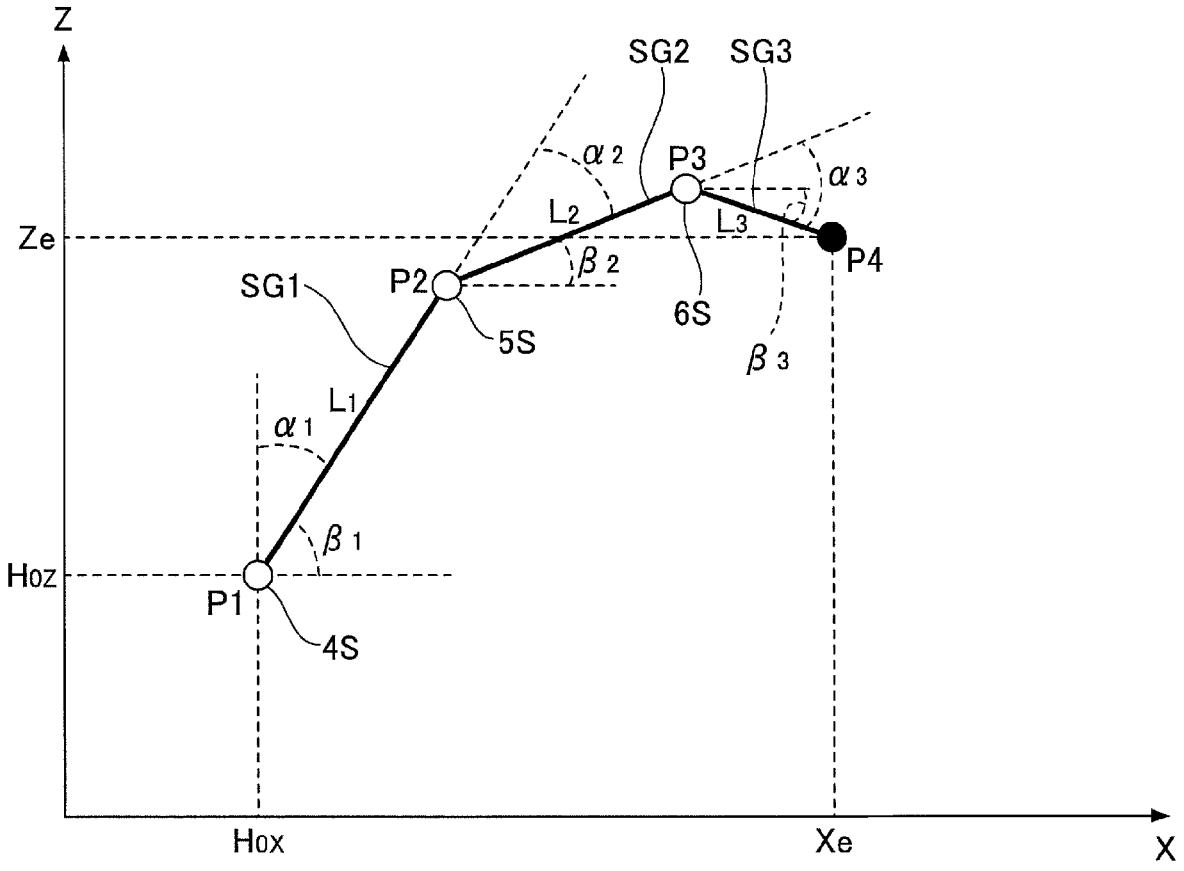
FIG. 4 is a diagram for explaining a movement of a front attachment in an XZ-plane.

Next, a description is given, with reference to FIG. 4, of a relationship between an output of each of the boom angle sensor 4S, arm angle sensor 5S and bucket angle sensor 6S and the boom rotation angle $\beta_1$, arm rotation angle $\beta_2$ and bucket rotation angle $\beta_3$. It should be noted that FIG. 4 is a diagram for explaining a movement of the front attachment in the XZ-plane.

As illustrated in FIG. 4, the boom angle sensor 4S is installed at the boom pin position P1, the arm angle sensor 5S is installed at the arm pin position P2 and the bucket angle sensor 6S is installed at the bucket pin position P3.

Moreover, the boom angle sensor 4S detects and outputs an angle $\alpha_1$ formed between the line segment SG1 and a vertical line. The arm angle sensor 5S detects and outputs an angle $\alpha_2$ formed between an extension line of the line segment SG1 and the line segment SG2. The bucket angle sensor 6S detects and outputs an angle $\alpha_3$ formed between an extension line of the line segment SG2 and the line segment SG3. It should be noted that, in FIG. 4, as to the angle $\alpha_1$, the counterclockwise direction with respect to the line segment SG1 is set as a plus direction. Similarly, as to the angle $\alpha_2$, the counterclockwise direction with respect to the line segment SG2 is set as a plus direction, and as to the angle $\alpha_3$, the counterclockwise direction with respect to the line segment SG3 is set as a plus direction. Moreover, in FIG. 4, as to the boom rotation angle $\beta_1$, arm rotation angle $\beta_2$ and bucket rotation angle $\beta_3$, the counterclockwise direction with respect to a line parallel to the X-axis is set as a plus direction.

According to the above-mentioned relationship, the boom rotation angle $\beta_1$, arm rotation angle $\beta_2$ and bucket rotation angle $\beta_3$ are represented by formulas (3), (4) and (5) using the angles $\alpha_1$, $\alpha_2$ and $\alpha_3$, respectively.

$$\beta_1=90-\alpha_1 \tag{3}$$

$$\beta_2=\beta_1-\alpha_2=90-\alpha_1-\alpha_2 \tag{4}$$

$$\beta_3=\beta_2-\alpha_3=90-\alpha_1-\alpha_2-\alpha_3 \tag{5}$$

As mentioned above, $\beta_1$, $\beta_2$ and $\beta_3$ are represented as inclinations of the boom 4, arm 5 and bucket 6, respectively, with respect to a horizontal plane.

Accordingly, using the formulas (1) through (5), if the angles $\alpha_1$, $\alpha_2$ and $\alpha_3$ are determined, the boom rotation angle $\beta_1$, arm rotation angle $\beta_2$ and bucket rotation angle $\beta_3$ are uniquely determined and the coordinate value of the bucket end position P4 is uniquely determined. Similarly, if the angle $\alpha_1$ is determined, the boom rotation angle $\beta_1$ and the coordinate value of the arm pin position P2 are uniquely determined, and if the angles $\alpha_1$ and $\alpha_2$ are determined, the boom rotation angle $\beta_2$ and the coordinate value of the bucket pin position P3 are uniquely determined.

It should be noted that the boom angle sensor 4S, arm angle sensor 5S and bucket angle sensor 6S may directly detect the boom rotation angle $\beta_1$, arm rotation angle $\beta_2$ and bucket rotation angle $\beta_3$, respectively. In this case, operations according to the formulas (3) through (5) may be omitted.

Figure 5A:
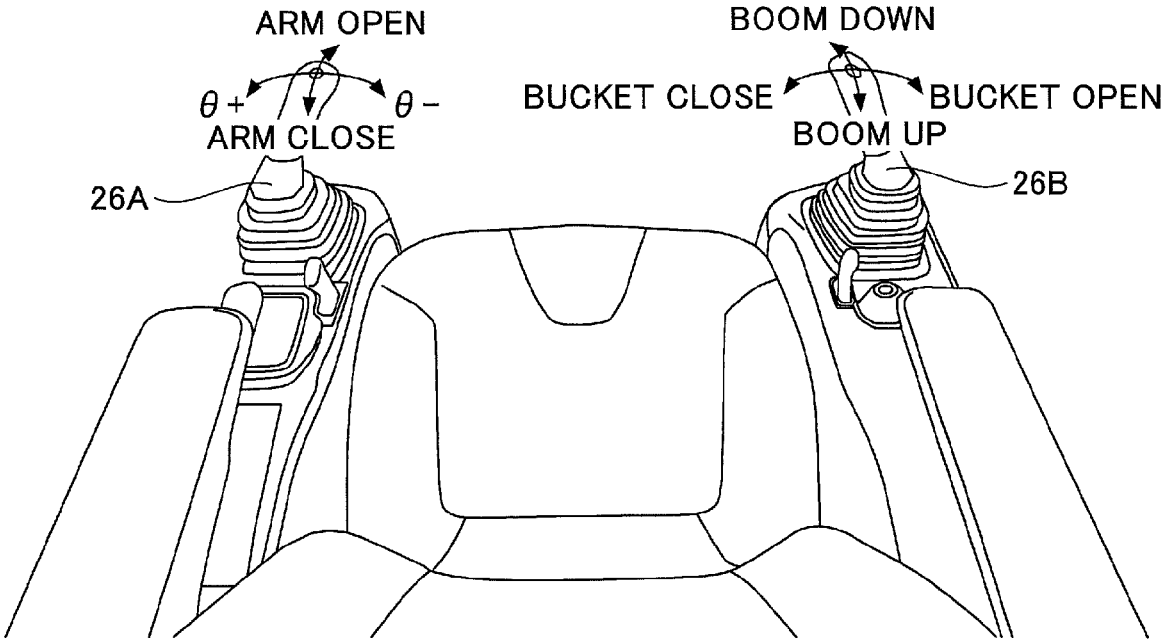
FIGS. 5A and 5B are top perspective views of a driver's seat in a cabin.
Figure 5B:
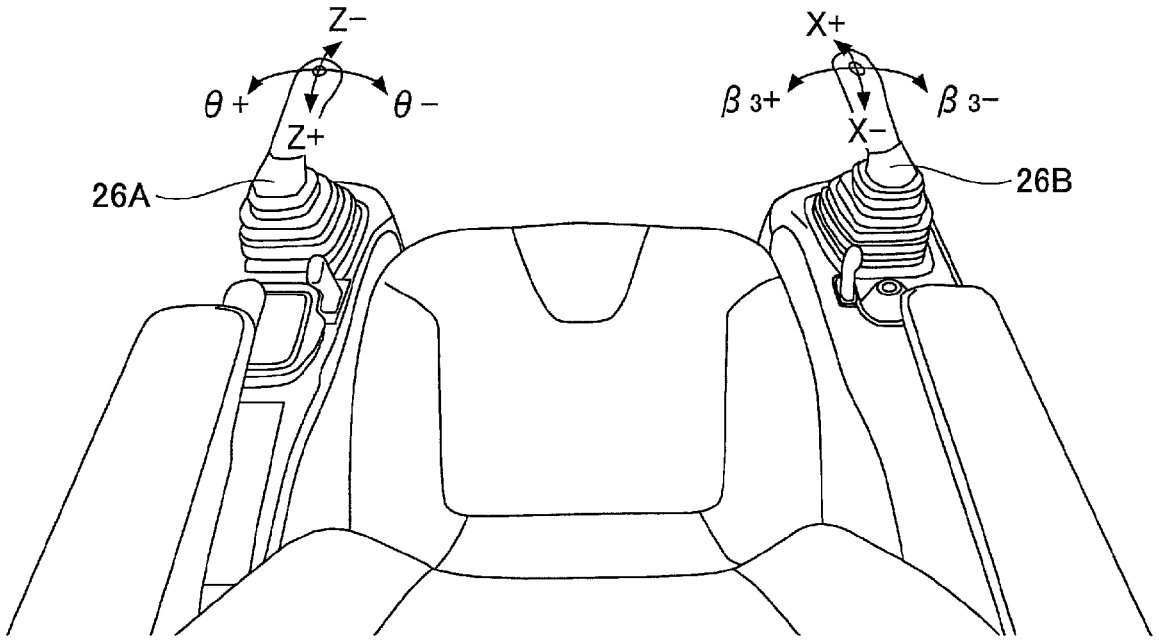

Next, a description is given, with reference to FIGS. 5A and 5B, of the operation device 26 used in the shovel control method according to the embodiment of the present invention. FIGS. 5A and 5B are top perspective views of a driver's seat in the cabin 10, and illustrate a state where the lever 26A is arranged on the left side and in front of the driver's seat and the lever 26B is arranged on the right side and in front of the driver's seat. Additionally, FIG. 5A illustrates a lever setting when a normal mode is set, and 5B illustrates a lever setting when an automatic leveling mode is set.

Specifically, in the normal mode of FIG. 5A, the arm 5 opens when tilting the lever 26A in a forward, direction and the arm 5 closes when tilting the lever 26A in a rearward direction. Additionally, the upper turning body 3 turns leftward in the counterclockwise direction in a top plan view when tilting the lever 26A in a leftward direction. The upper turning body 3 turns rightward in the clockwise direction in a top plan view when tilting the lever 26A in a rightward direction. Additionally, the boom 4 moves downward when tilting the lever 26B in a forward direction, the boom 4 moves upward when tilting the lever 26B in a rearward direction. Additionally, the bucket 6 closes when tilting the lever 26B in a leftward direction, and the bucket opens when tilting the lever 26B in a rightward direction.

On the other hand, in the automatic leveling mode of FIG. 5B, when tilting the lever 26A in a forward direction, at least one of the boom 4 and arm 5 moves so that a value of the Z-axis is decreased while values of the X coordinate and Y coordinate of the bucket end position P4 are maintained unchanged. It should be noted that the bucket 6 may move. Additionally, when tilting the lever 26A in a rearward direction, at least one of the boom 4 and arm 5 moves so that a value of the Z-axis is increased while values of the X coordinate and Y coordinate of the bucket end position P4 are maintained unchanged. It should be noted that the bucket 6 may move. Hereinafter, an operation of the lever 26A in the forward or rearward direction, that is, a control performed in response to a Z-direction operation of the bucket 6 as an end attachment is referred to as the "Z-direction movement control" or "height control". It should be noted that the operation of the lever 26A in the leftward or rightward direction is the same as that in the normal mode.

Moreover, in the automatic leveling mode of FIG. 5B, when tilting the lever 26B in a forward direction, at least one of the boom 4 and arm 5 moves so that a value of the X-axis is increased while values of the Y coordinate and Z coordinate of the bucket end position P4 are maintained unchanged. It should be noted that the bucket 6 may move. Additionally, when tilting the lever 26B in a rearward direction, at least one of the boom 4 and arm 5 moves so that a value of the X-axis is decreased while values of the Y coordinate and Z coordinate of the bucket end position P4 are maintained unchanged. Note that the bucket 6 may move. Hereinafter, an operation of the lever 26B in the forward or rearward direction, that is, a control performed in response to an X-direction operation of the bucket 6 as an end attachment is referred to as the "X-direction movement control" or "plane position control".

Moreover, in the automatic leveling mode of FIG. 5B, the bucket rotation angle $\beta_3$ increases when tilting the lever 26B in a leftward direction, and the bucket rotation angle $\beta_3$ decreases when tilting the lever 26B in a rightward direction. That is, the bucket 6 closes when tilting the lever 26B in the leftward direction, and the bucket 6 opens when tilting the lever 26B in the rightward direction. Thus, the movement of the bucket 6 caused by an operation of the lever 26B in the leftward or rightward direction is the same as that in the case of the normal mode. However, it differs in that the bucket 6 is moved by determining a target value of the bucket rotation angle $\beta_3$ corresponding to a lever operation amount in the automatic leveling mode while the bucket 6 is moved by supplying an operating oil of an amount of flow corresponding to a lever operation amount in the normal mode. A description of a control in the automatic leveling mode will be given later.

Figure 6:
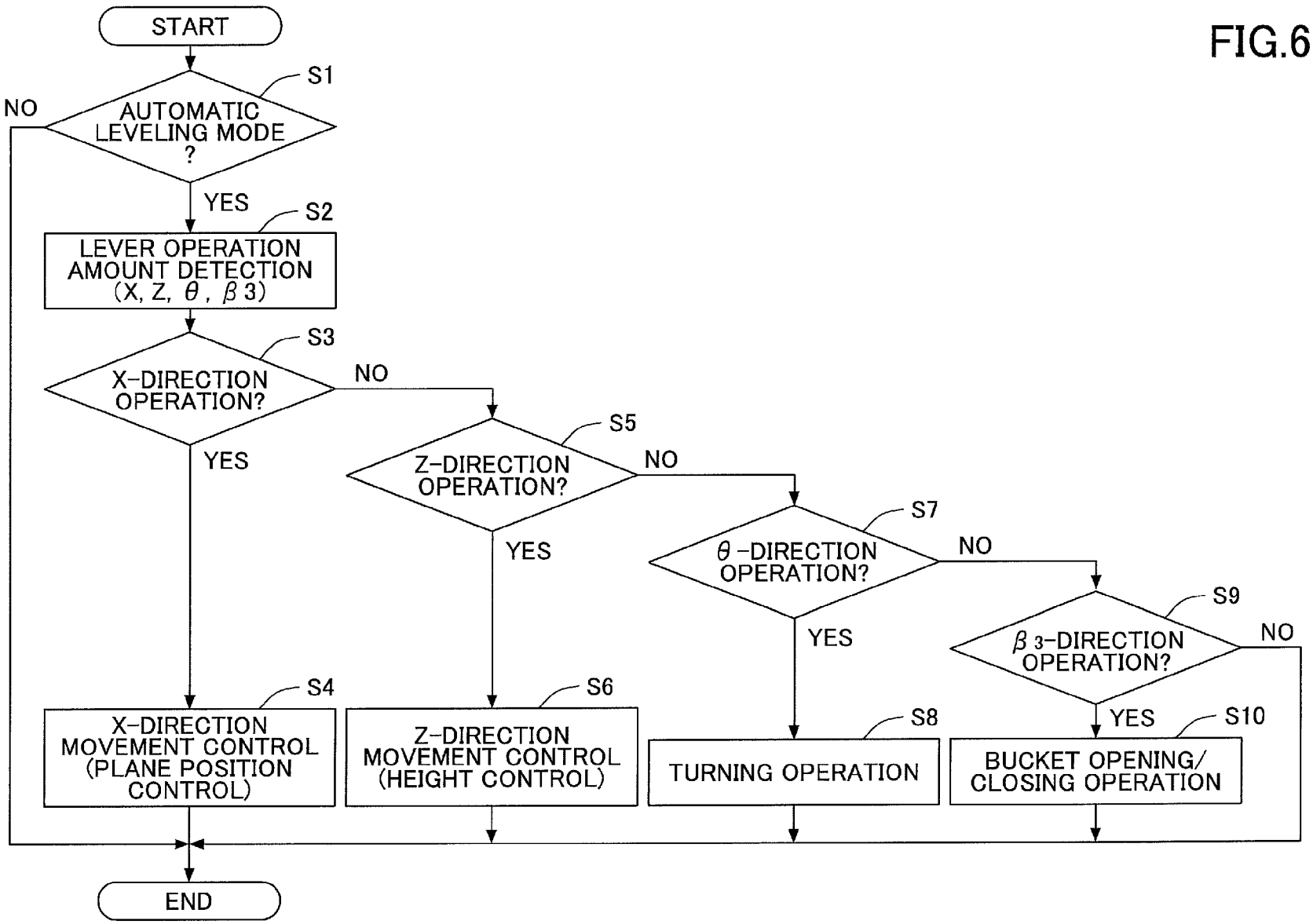
FIG. 6 is a flowchart indicating a process flow when a lever operation is performed in an automatic leveling mode.

FIG. 6 is a flowchart indicating a process flow when a lever operation is performed in the automatic leveling mode.

First, the controller 30 judges whether the automatic leveling mode is selected in a mode change switch installed near the driver's seat in the cabin 10 (step S1).

If the controller 30 determines that the automatic leveling mode is selected (YES in step S1), the controller 30 detects a lever operation amount (step S2).

Specifically, the controller 30 detects amounts of operations of the levers 26A and 26B based on, for example, outputs of the pressure sensor 29.

Thereafter, the controller 30 judges whether an X-direction operation is performed (step S3). Specifically, the controller 30 judges whether an operation of the lever 26B in a forward or rearward direction is performed.

If the controller 30 judges that the X-direction operation is performed (YES in step S3), the controller 30 performs an X-direction movement control (plane position control) (step S4).

If the controller 30 judges that the X-direction, operation is not performed (NO in step S3), the controller 30 judges whether a Z-direction operation is performed (step S5). Specifically, the controller 30 judges whether an operation of the lever 26A in a forward or rearward direction is performed.

If the controller 30 judges that the Z-direction operation is performed (YES in step S5), the controller 30 performs a Z-direction movement control (height control) (step S6).

If the controller judges that the Z-direction operation is not performed (NO in step S5), the controller 30 judges whether a θ-direction operation is performed (step S7). Specifically, he controller 30 judges whether a leftward or rightward operation of the lever 26A is performed.

If the controller 30 judges that a θ-direction operation is performed (YES in step S7), the controller 30 performs a turning operation (step S8).

If the controller 30 judges that a θ-direction operation is not performed (NO in step S7), the controller judges whether a $\beta_3$-direction operation is performed (step S9). Specifically, the controller 30 judges whether a leftward or rightward operation of the lever 26B is performed.

If the controller 30 judges that a $\beta_3$-direction operation is performed (YES in step S9), the controller 30 performs a bucket opening or closing operation (step S10).

It should be noted that although the control flow illustrated in FIG. 6 is applied to a case of single operation where one of an X-direction operation, Z-direction operation, θ-direction operation and $\beta_3$-direction operation is performed, it is also applicable to a case of compound operation where a plurality of operations from among those four operations are performed simultaneously. For example, a plurality of controls from among an X-direction movement control, Z-direction movement control, turning operation and bucket opening/closing operation may be performed simultaneously.

Figure 7:
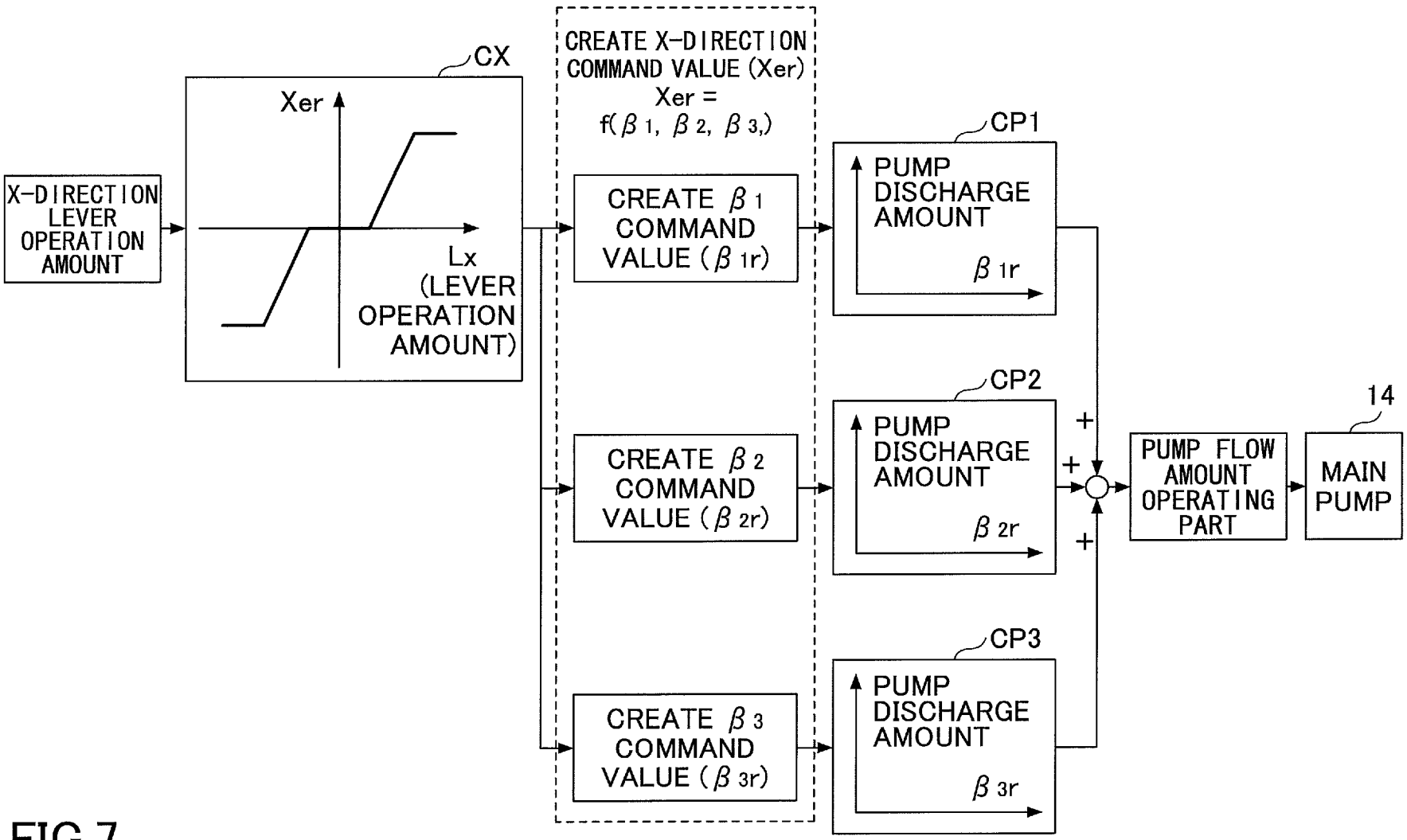
FIG. 7 is a block diagram (part 1) illustrating a flow of an X-direction movement control.
Figure 8:
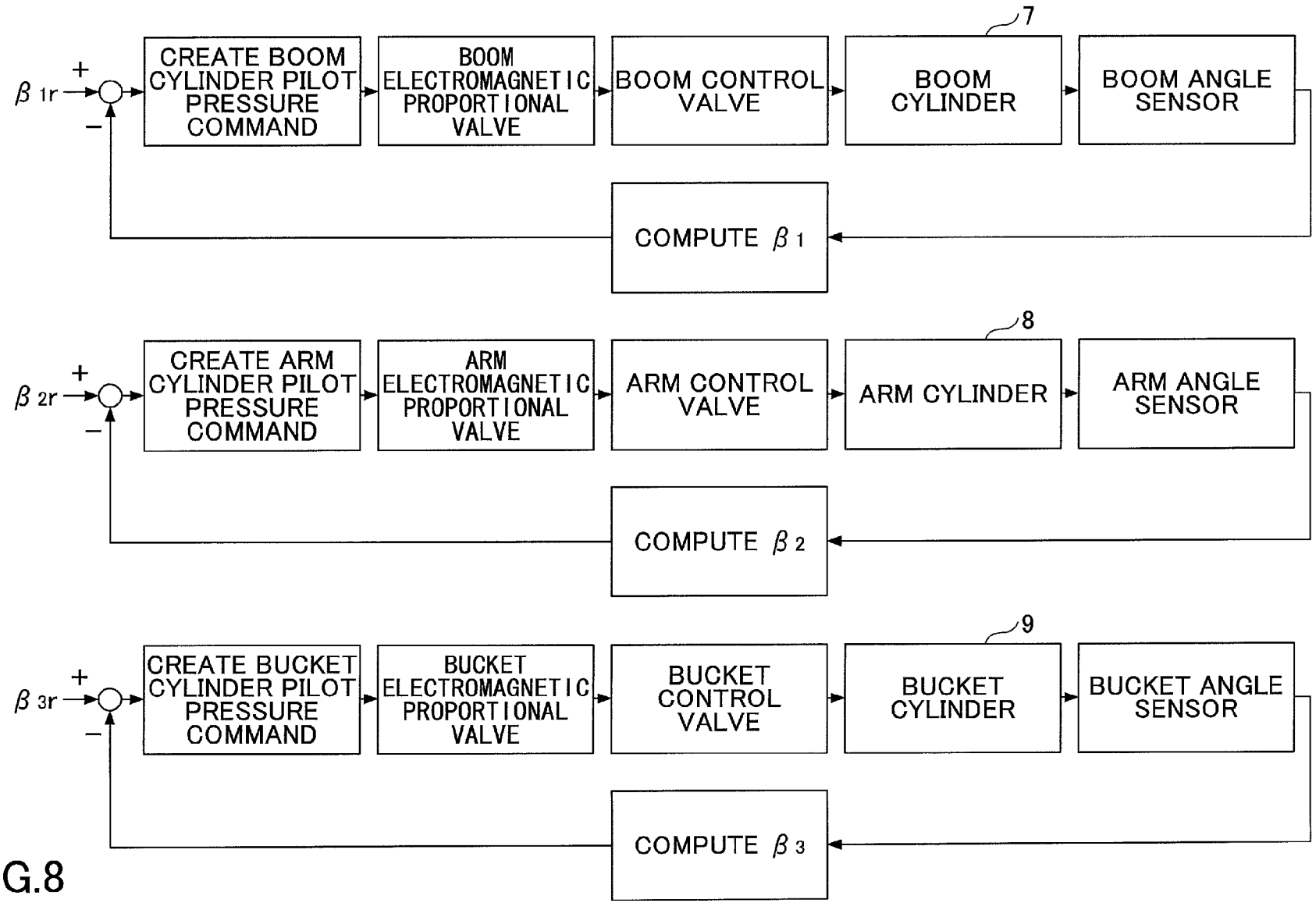
FIG. 8 is a block diagram (part 2) illustrating the flow of the X-direction movement control.

Next, a description is given, with reference to FIGS. 7 and 8, of details of the X-direction movement control (plane position control). FIGS. 7 and 8 are block diagrams illustrating a flow of the X-direction movement control.

When an X-direction operation is performed by the lever 26B, as illustrated in FIG. 7, the controller 30 performs an open-loop control on a displacement in the X-axis direction of the bucket end position P4 in response to the X-direction operation of the lever 26B. Specifically, the controller 30 creates, for example, a command value Xer as a value of the X coordinate after movement of the bucket end position P4. More specifically, the controller 30 creates the X-direction command value Xer corresponding to a lever operation amount Lx of the lever 26B by using an X-direction command creating part CX. The X-direction command creating part CX derives the X-direction command value Xer from the lever operation amount Lx using, for example, a previously registered table. Moreover, the X-direction command creating part CX creates the value Xer so that, for example, a difference ΔXe between the value Xe of the X coordinate before a movement of the bucket end position P4 and the value Xer of the X coordinate after the movement of the bucket end position P4 becomes larger as an amount of operation of the lever 26B increases. It should be noted that the controller 30 may create the value Xer so that the value ΔXe is constant irrespective of an amount of operation of the lever 26B. Moreover, the values of the Y coordinate and Z coordinate of the bucket end position P4 are unchanged between before and after the movement.

Thereafter, the controller 30 creates command values $\alpha_1$r, $\beta_2$r and $\beta_3$r for the boom rotation angle $\beta_1$, arm rotation angle $\beta_2$ and bucket rotation angle $\beta_3$, respectively, based on the created command value Xer.

Specifically, the controller 30 creates the command values $\beta_1$r, $\beta_2$r and $\beta_3$r using the above-mentioned formulas (1) and (2). As indicated by the formulas (1) and (2), the values Xe and Ze of the X coordinate and Z coordinate of the bucket end position P4 are functions of the boom rotation angle $\beta_1$, arm rotation angle $\beta_2$ and bucket rotation angle $\beta_3$. Moreover, a present value is used in the value Zer of the Z coordinate of the bucket end position P4 after movement. Accordingly, if the command value $\beta_3$r of the bucket rotation angle $\beta_3$ is maintained at a present value, the created command value Xer is substituted for Xe in the formula (1), and a present value is substituted for $\beta_3$ in the formula (1). Additionally, a present value is substituted for Ze in the formula (2), and a present value is also substituted for $\beta_3$ in the formula (2). As a result, the values of the boom rotation angle $\beta_1$ and arm rotation angle $\beta_2$ are derived by solving the simultaneous equations of the formulas (1) and (2) containing the two unknown quantities $\beta_1$ and $\beta_2$. The controller 30 sets the derived values to the command values $\beta_1$r and $\beta_2$r.

Thereafter, as illustrated in FIG. 8, the controller 30 causes the boom 4, arm 5 and bucket 6 to move so that values of the boom rotation angle $\beta_1$, arm rotation angle $\beta_2$ and bucket rotation angle $\beta_3$ coincide with the command values $\beta_1$r, $\beta_2$r and $\beta_3$r, respectively. It should be noted that the controller 30 may derive the command values $\alpha_1$r, $\alpha_2$r and $\alpha_1$r corresponding to the command values $\beta_1$r, $\beta_2$r and $\beta_3$r by using the formulas (3) through (5). Then, the controller 30 may cause the boom 4, arm 5 and bucket 6 to move so that the angles $\alpha_1$, $\alpha_2$ and $\alpha_3$, which are outputs of the boom angle sensor 4S, arm angle sensor 5S and bucket angle sensor 6S, coincide with the command values $\alpha_1$r, $\alpha_2$r and $\alpha_1$r, respectively.

Specifically, the controller 30 creates a boom cylinder pilot pressure command corresponding to a difference $\Delta\beta_1$ between a present value and the command value $\beta_1$r of the boom rotation angle $\beta_1$. Then, a control current corresponding to the boom cylinder pilot pressure command is output to a boom electromagnetic proportional valve. In the automatic leveling mode, the boom electromagnetic proportional valve outputs a pilot pressure corresponding to the control current according to the boom cylinder pilot pressure command to a boom control valve. It should be noted that, in the normal mode, the boom electromagnetic proportional valve outputs to the boom control valve a pilot pressure corresponding to an amount of operation of the lever 26B in a forward or rearward direction.

Thereafter, upon receipt of the pilot pressure from the boom electromagnetic proportional valve, the boom control valve supplies the operating oil, which is discharged from the main pump 14, to the boom cylinder 7 with a direction of flow and an amount of flow corresponding to the pilot pressure. The boom cylinder 7 extends or retracts due to the operating oil supplied via the boom control valve. The boom angle sensor 4S detects the angle $\alpha_1$ of the boom 4, which is moved by the extending/retracting cylinder 7.

Thereafter, the controller 30 computes the boom rotation angle $\beta_1$ by substituting the angle $\alpha_1$, which is detected by the boom angle sensor 4S, into the formula (3). Then, the computed value is fed back as a present value of the boom rotation angle $\beta_1$, which is used when creating the boom cylinder pilot pressure command.

It should be noted that although the above description is directed to the operation of the boom according to the command value $\beta_1$r, the same is applicable to the operation of the arm 5 based on the command value $\beta_2$r and the operation of the bucket 6 based on the command value $\beta_3$r. Thus, descriptions of the operation of the arm 5 based on the command value $\beta_2$r and the operation of the bucket 6 based on the command value $\beta_3$r will be omitted.

Moreover, as illustrated in FIG. 7, the controller 30 derives a pump discharge amount from the command values $\beta_1$r, $\beta_2$r and $\beta_3$r by using pump discharge amount deriving parts CP1, CP2 and CP3. In the present embodiment, each of the pump discharge amount deriving parts CP1, CP2 and CP3 derives the pump discharge amount from the command values $\beta_1$r, $\beta_2$r and $\beta_3$r using a previously registered table or the like. The pump discharge amounts derived by the pump discharge amount deriving parts CP1, CP2 and CP3 are summed up and input to a pump flow amount operating part as a total pump discharge amount. The pump flow amount operating part controls an amount of discharge of the main pump 14 based on the input total pump discharge amount. In the present embodiment, the pump flow amount operating part controls an amount of discharge of the main pump 14 by changing a swash plate tilting angle of the main pump 14 in response to the total pump discharge amount.

As a result, the controller 30 can distribute an appropriate amount of operating oil to the boom cylinder 7, arm cylinder 8 and bucket cylinder 9 by performing a control of opening the bucket control valve and a control of an amount of discharge of the main pump 14.

Thus, the controller 30 performs the X-direction movement control of the bucket end position P4 by repeating a control cycle, which includes the creation of the command value Xer, the creation of the command values $\beta_1$r, $\beta_2$r and $\beta_3$r, the control of an amount of discharge of the main pump 14, and the feedback control of the operating bodies 4, 5 and 6 based on the outputs of the angle sensors 4S, 5S and 6S.

In the above description, a present value of the bucket rotation angle $\beta_3$ is used as it is as the command value $\beta_3$r of the bucket rotation angle $\beta_3$. However, a value uniquely determined in response to a value of the arm rotation angle $\beta_2$, that is, for example, a value of the arm rotation angle $\beta_3$r added with a fixed value may be used as the command value $\beta_3$r of the bucket rotation angle $\beta_3$.

Moreover, in the X-direction movement control, a displacement in the X coordinated of the bucket end position P4 is open-loop controlled while fixing the Y coordinate and Z coordinate of the bucket end position P4. However, a displacement in the X coordinate of the bucket pin position P3 may be open-loop controlled while fixing the Y coordinate and Z coordinate of the bucket pin position P3. In this case, the creation of the command value $\beta_3$r and the control of the bucket 6 are omitted.

Figure 9:
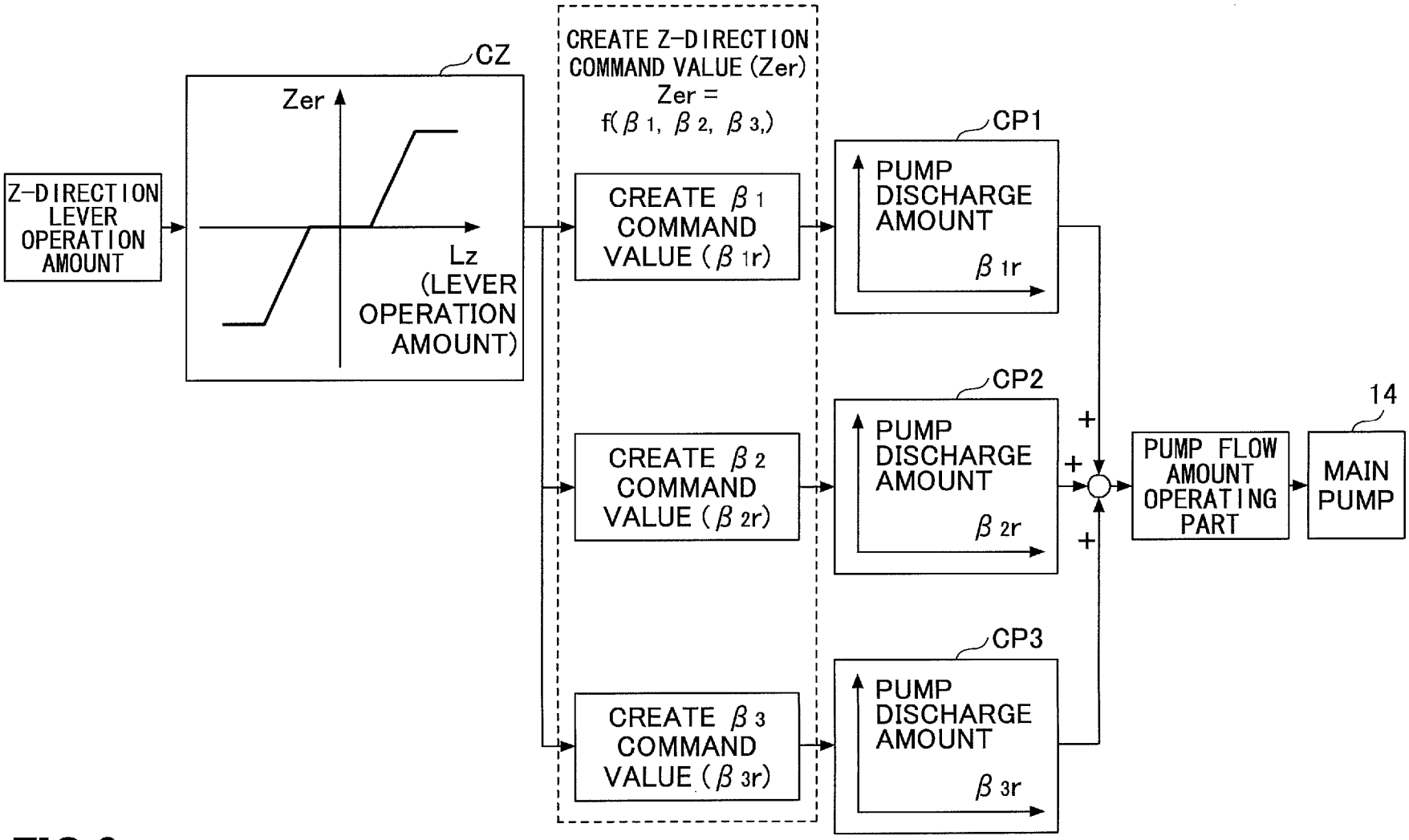
FIG. 9 is a block diagram (part 1) illustrating a flow of a Z-direction movement control.
Figure 10:
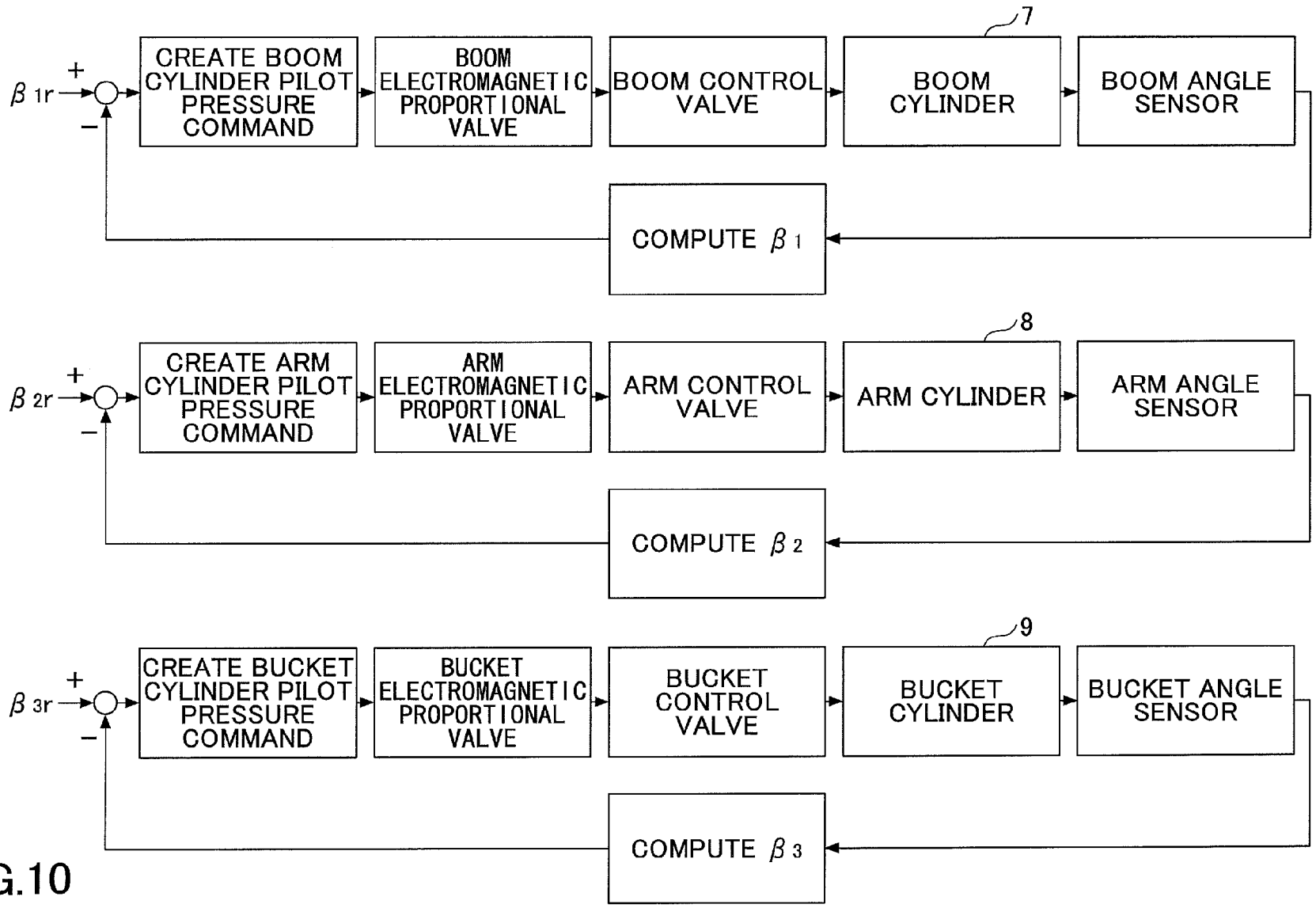
FIG. 10 is a block diagram (part 2) illustrating the flow of the Z-direction movement control.

A description is given, with reference to FIGS. 9 and 10, of details of the Z-direction movement control (height control). FIGS. 9 and 10 are block diagrams illustrating a flow of the Z-direction movement control.

When the Z-direction operation is performed with the lever 26A, the controller 30 open-loop controls, as illustrated in FIG. 9, a displacement of the bucket end position P4 in the Z-axis direction in response to the Z-direction operation of the lever 26A. Specifically, the controller 30 creates, for example, a command value Zer as a value of the Z coordinate after movement of the bucket end position P4. More specifically, the controller 30 creates the Z-direction command value Zer corresponding to a lever operation amount Lz of the lever 26A by using a Z-direction command creating part CZ. The Z-direction command creating part CZ derives the Z-direction command value Zer from the lever operation amount Lz using, for example, a previously registered table. Moreover, the Z-direction command creating part CZ creates the value Zer so that, for example, a difference ΔZe between the value Ze of the Z coordinate before movement of the bucket end position P4 and the value Zer of the Z coordinate after the movement of the bucket end position P4 becomes larger as an amount of operation of the lever 26A increases. It should be noted that the controller 30 may create the value Zer so that the value ΔZe is constant irrespective of an amount of operation of the lever 26A. Moreover, the values of the X coordinate and Y coordinate of the bucket end position P4 are unchanged between before and after the movement.

Thereafter, the controller 30 creates command values $\beta_1$r, $\beta_2$r and $\beta_3$r for the boom rotation angle $\beta_1$, arm rotation angle $\beta_2$ and bucket rotation angle $\beta_3$, respectively, based on the created command value Zer.

Specifically, the controller 30 creates the command values $\beta_1$r, $\beta_2$r and $\beta_3$r using the above-mentioned formulas (1) and (2). As indicated by the formulas (1) and (2), the values Xe and Ze of the X coordinate and Z coordinate of the bucket end position P4 are functions of the boom rotation angle $\beta_1$, arm rotation angle $\beta_2$ and bucket rotation angle $\beta_3$. Moreover, a present value is used as it is for the value Xer of the X coordinate of the bucket end position P4 after movement. Accordingly, if the command value $\beta_3$r of the bucket rotation angle $\beta_3$ is maintained at a present value, the present value is substituted for Xe in the formula (1), and the present value is also substituted for $\beta_3$ in the formula (1). Additionally, the created command value Zer is substituted for Zr in the formula (2), and a present value is substituted for, $\beta_3$ in the formula (2). As a result, the values of the boom rotation angle $\beta_1$ and arm rotation angle $\beta_2$ are derived by solving the simultaneous equations of the formulas (1) and (2) containing the two unknown quantities $\beta_1$ and $\beta_2$. The controller 30 sets the derived values to the command values $\beta_1$r and $\beta_2$r.

Thereafter, as illustrated in FIG. 10, the controller 30 causes the boom 4, arm 5 and bucket 6 to move so that values of the boom rotation angle $\beta_1$, arm rotation angle $\beta_2$ and bucket rotation angle $\beta_3$ coincide with the created command values $\beta_1$r, $\beta_2$r and $\alpha_1$r, respectively. It should be noted that the previously mentioned X-direction movement control is applicable to the operations of the boom 4, arm 5 and bucket 6 and the control of an amount of discharge of the main pump 14 in the present embodiment, and descriptions thereof will be omitted.

Thus, the controller 30 performs a Z-direction movement control of the bucket end position P4 by repeating a control cycle, which includes the creation of the command value Zer, the creation of the command values $\beta_1$r, $\beta_2$r and $\alpha_1$r, the control of an amount of discharge of the main pump 14, and the feedback control of the operating bodies 4, 5 and 6 based on the outputs of the angle sensors 4S, 5S and 6S.

In the above description, a present value of the bucket rotation angle $\beta_3$ is used as it is as the command value $\beta_3$r of the bucket rotation angle $\beta_3$. However, a value uniquely determined in response to a value of the arm rotation angle $\beta_2$, that is, for example, a value of the arm rotation angle $\beta_3$r added with a fixed value may be used as the command value $\beta_3$r of the bucket rotation angle $\beta_3$.

Moreover, in the Z-direction movement control, a displacement in the Z coordinate of the bucket end position P4 is open-loop controlled while fixing the Y coordinate and Z coordinate of the bucket end position P4. However, a displacement in the Z-direction of the bucket pin position P3 may be open-loop controlled while fixing the X coordinate and Y coordinate of the bucket pin position P3. In this case, the creation of the command value $\beta_3$r and the control of the bucket 6 are omitted.

As explained above, in the shovel control method according to the embodiment of the present invention, amounts of operations of the levers are used not for the extension/retraction control of the respective boom cylinder 7, arm cylinder 8 and bucket cylinder 9 but for the position control of the bucket end position P4. Thus, the present control method can materialize the operation of increasing/decreasing the value of the Z coordinate by an operation of a single lever while maintaining the bucket rotation angle $\beta_3$ and the values of the X coordinate and Y coordinate of the bucket end position P4. Additionally, the operation of increasing/decreasing the value of the X coordinate can be materialized by an operation of a single lever while maintaining the bucket rotation angle $\beta_3$ and the values of the Y coordinate and Z coordinate of the bucket end position P4.

Moreover, according to the present control method, the lever operation amount can be used in a position control of the bucket pin position P3 by setting a plane position of the end attachment and a height of the end attachment to the bucket pin position P3. In this case, the present control method can materialize the operation of increasing/decreasing the value of the Z coordinate by an operation of a single lever while maintaining the values of the X coordinate and Y coordinate of the bucket pin position P3. Additionally, the operation of increasing/decreasing the value of the X coordinate can be materialized by an operation of a single lever while maintaining the values of the Y coordinate and Z coordinate of the bucket pin position P3. In this case, on the assumption that the three-dimensional coordinate of the bucket pin position P3 is represented by (X, Y, Z)=($X_{P3}$, $Y_{P3}$, $Z_{P3}$), $X_{P3}$ and $Z_{P3}$ are represented by the following formulas (6) and (7), respectively.

$$X_{P3}=H_{0X}+L_1 \cos \beta_1+L_2 \cos \beta_2 \quad (6)$$

$$Z_{P3}=H_{0Z}+L_1 \sin \beta_1+L_2 \sin \beta_2 \quad (7)$$

It should be noted that $Y_{P3}$ is zero. This is because the bucket pin position P3 is on the XZ plane.

Additionally, in this case, the command value $\beta_3$r is not created from the command value Xer in the X-direction movement control, and the command value $\beta_3$r is not created from the command value Zer in the Z-direction movement control.

Figure 11:
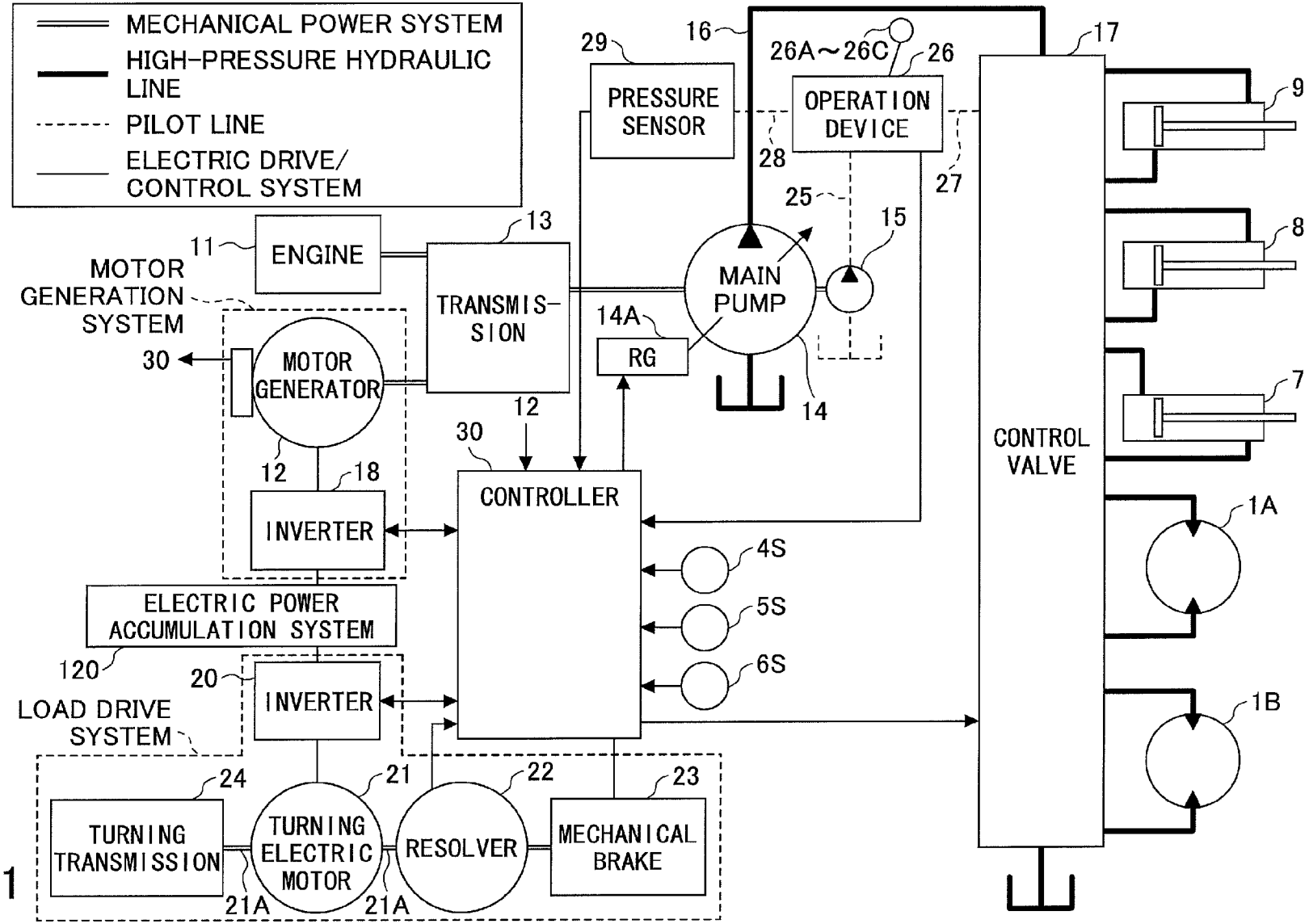
FIG. 11 is a block diagram illustrating a structural example of a drive system of a hybrid shovel performing a control method according to an embodiment of the present invention.

Next, a description is given, with reference to FIG. 11, of a hybrid shovel performing the control method according to the embodiment of the present invention. FIG. 11 is a block diagram illustrating a structural example of a drive system of the hybrid shovel. In FIG. 11, double solid lines denote a mechanical power system, bold solid lines denote high-pressure hydraulic lines, dashed thin lines denote pilot lines, and dotted thin lines denote an electric drive/control system. The drive system of FIG. 11 differs from the drive system of FIG. 2 in that the drive system of FIG. 11 includes a motor generator 12, a transmission 13, an inverter 18 and an electric storage system 120, and also includes, instead of the turning hydraulic motor 21B, an inverter 20, a load drive system constituted by a turning electric motor 21, a resolver 22, a mechanical brake 23 and a turning transmission 24. However, it is common to the drive system of FIG. 2 in other points. Thus, a description is given in detail while omitting descriptions of common points.

In FIG. 11, the engine 11 as a mechanical drive part and the motor generator 12 as an assist drive part, which also performs a generating operation, are connected to input axes of the transmission 13, respectively. The main pump 14 and pilot pump 15 are connected to an output axis of the transmission 13.

The electric storage system (electric storage device) 120 including a capacitor as an electric accumulator is connected to the motor generator 12 via the inverter 18.

The electric storage system 120 is arranged between the inverter 18 and the inverter 20. Thereby, when at least one of the motor generator 12 and turning electric motor 21 is performing a power running operation, the electric storage system 120 supplies an electric power necessary for the power running operation, and when at least one of them is performing a generating operation, the electric storage system 120 accumulates an electric power generated by the generating operation as an electric energy.

Figure 12:
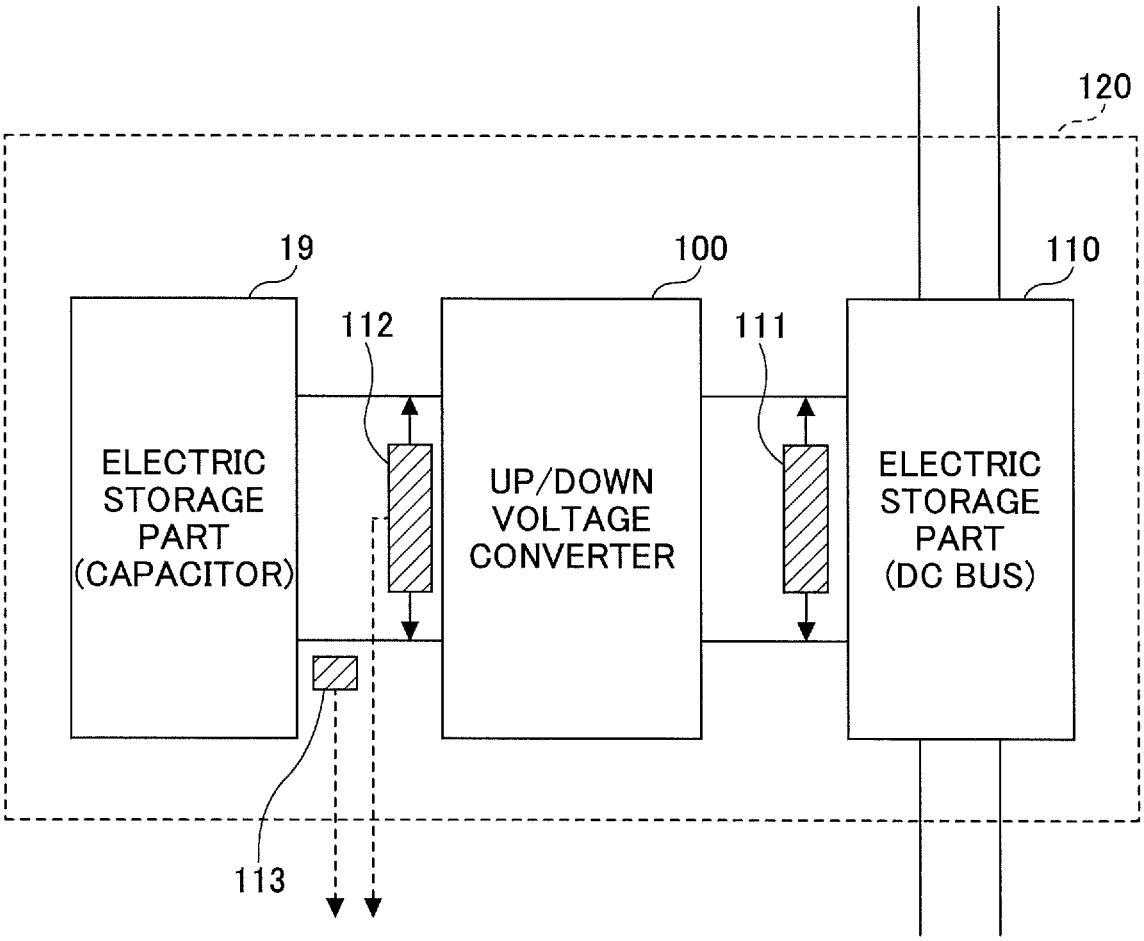
FIG. 12 is a block diagram illustrating a structural example of an electric storage system of the hybrid shovel.

FIG. 12 is a block diagram illustrating a structural example of the electric storage system 120. The electric storage system 120 includes the capacitor 19 as an electric accumulator, an up/down voltage converter 100 and a DC bus 110 as a second electric accumulator. The DC bus 110 controls transfer of an electric power between the capacitor 19, the motor generator 12 and the turning electric motor 21. The capacitor 19 is provided with a capacitor voltage detecting part 112 for detecting a capacitor voltage value and a capacitor current detecting part 113 for detecting a capacitor current value. The capacitor voltage value and the capacitor current value detected by the capacitor voltage detecting part 112 and the capacitor current detecting part 113 are supplied to the controller 30. Although the capacitor 19 is illustrated as an example of an electric accumulator in the above description, a chargeable secondary battery such as a lithium ion battery, a lithium ion capacitor, or a power supply of another form that can transfer an electric power may be used instead of the capacitor 19.

The up/down voltage converter 100 performs a control of switching a voltage-up operation and a voltage-down operation in accordance with operating states of the motor generator 12 and the turning electric motor 21 so that a DC bus voltage value falls within a fixed range. The DC bus 110 is arranged between the inverters 18 and 20 and the up/down voltage converter 100, and performs transfer of an electric power between the capacitor 19, the motor generator 12 and the turning motor 21.

Returning to FIG. 11, the inverter 20 is provided between the turning electric motor 21 and the electric storage system 120 to perform an operation control on the turning electric motor 21 based on a command from the controller 30. Thereby, when the turning electric motor 21 is performing a power running operation, the inverter 20 supplies a necessary electric power from the electric storage system 120 to the turning electric motor 21. On the other hand, when the turning electric motor 21 is performing a generating operation, the inverter 20 accumulates an electric power generated by the turning electric motor 21 in the capacitor 19 of the electric storage system 120.

The turning electric motor 21 may be an electric motor that is capable of performing both a power running operation and generating operation, and is provided to drive the turning mechanism of the upper turning body 3. When performing a power running operation, a rotational drive force of the turning electric motor 21 is amplified by the turning transmission 24, and the upper tuning body 3 is acceleration/deceleration controlled to perform a rotating operation. On the other hand, when performing a generating operation, a number of revolutions of inertial rotation of the upper turning body 3 is increased by the transmission 24 and transmitted to the turning electric motor 21, which can generate a regenerative electric power. Here, the turning electric motor 21 is an electric motor that is alternate-current-driven by the inverter 20 according to a PWM (Pulse Width Modulation) control signal. The turning electric motor 21 can be constituted by, for example, an IPM motor of embedded magnet type. According to this, a greater electromotive force can be generated, which can increase an electric power generated by the turning electric motor 21 when performing a regenerative operation.

It should be noted that the charge/discharge control for the capacitor 19 of the electric storage system 120 is performed by the controller 30 based on a charged state of the capacitor 19, an operating state (a power running operation or generating operation) of the motor generator 12 and an operating state (a power running operation or generating operation) of the turning electric motor 21.

The resolver 22 is a sensor for detecting a rotation position and rotation angle of the rotational axis 21A of the turning electric motor 21. Specifically, the resolver 22 detects a rotation angle and rotating direction of the rotational axis 21A by detecting a difference between a rotation position of the rotation position before a rotation of the turning electric motor 21 and a rotation position after a leftward rotation or a rightward rotation. By detecting a rotation position and rotating direction of the rotation axis 21A of the turning electric motor 21, a rotation angle and rotating direction of the turning mechanism 2 can be derived.

The mechanical brake 24 is a brake device for generating a mechanical braking force to mechanically stop the rotational axis 21A of the turning electric motor 21. Braking/releasing of the mechanical brake 23 is switched by an electromagnetic switch. The switching is performed by the controller 30.

The turning transmission 24 is a transmission for mechanically transmitting the rotation of the rotational axis 21A of the turning electric motor 21 by reducing a rotating speed. Accordingly, when performing a power running operation, a greater rotating force can be boosted by boosting the rotating force of the turning electric motor 21. On the contrary, when performing a regenerative operation, the rotation generated in the upper turning body 3 can be mechanically transmitted to the turning electric motor 21 by increasing the rotating speed.

The turning mechanism 2 can be turned in a state where the mechanical brake 23 of the turning electric motor 21 is released, and, thereby, the upper turning body 3 is turned in a leftward direction or a rightward direction.

The controller 30 performs a drive control of the motor generator 12, and also performs a charge/discharge control of the capacitor 19 by controlling driving the up/down voltage converter 100 as an up/down voltage control part. The controller 30 performs the switching control of a voltage-up operation and a voltage-down operation of the up/down voltage converter 100 based on a charged state of the capacitor 19, an operating state (a power assist operation or generating operation) of the motor generator 12 and an operating state (a power running operation or regenerative operation) of the turning electric motor 21 so as to perform the charge/discharge control of the capacitor 19. Additionally, the controller 30 performs a control of an amount of charge (a charge current or a charge electric power) to the capacitor 19.

The switching control between the voltage-up operation and the voltage-down operation by the up/down voltage converter 100 is performed based on a DC bus voltage value detected by the DC bus voltage detecting part 111, a capacitor voltage value detected by the capacitor voltage detecting part 112 and a capacitor current value detected by the capacitor current detecting part 113.

The electric power generated by the motor generator 12, which is an assist motor, is supplied to the DC bus 110 of the electric storage system 120 through the inverter 180, and then supplied to the capacitor 19 through the up/down voltage converter 100. Moreover, the regenerative electric power generated by the regenerative operation of the turning electric motor 21 is supplied to the DC bus 110 of the electric storage system 120 through the inverter 20, and then supplied to the capacitor 19 through the up/down voltage converter 100.

Figure 13:
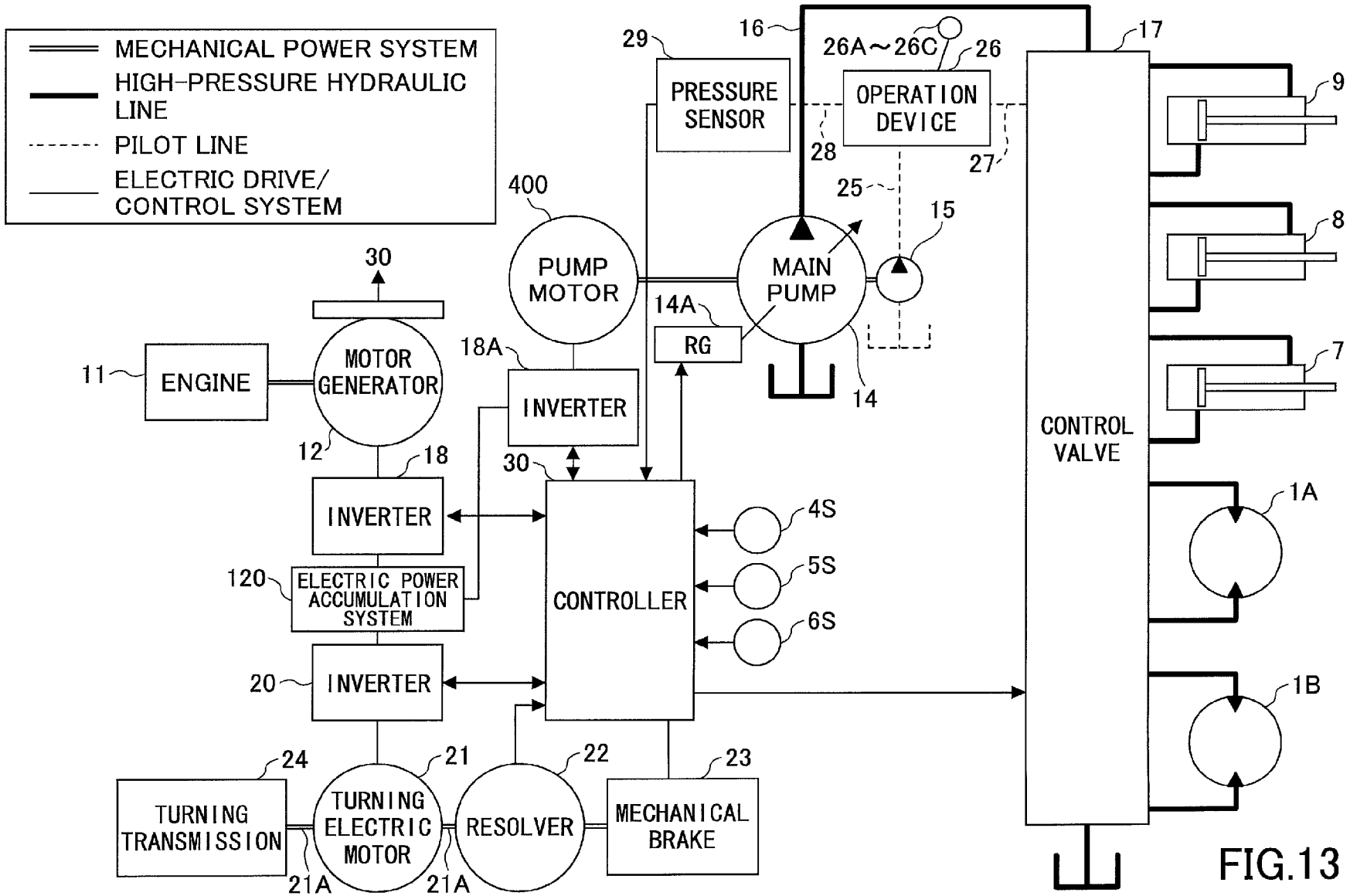
FIG. 13 is a block diagram illustrating another structural example of the drive system of the hybrid shovel performing the control method according to the embodiment of the present invention.

Next, a description is given, with reference to FIG. 13, of another example of the hybrid shovel that performs the control method according to the embodiment of the present invention. It should be noted that FIG. 13 is a block diagram illustrating a drive system of the hybrid shovel. In FIG. 13, double solid lines denote a mechanical power system, bold solid lines denote high-pressure hydraulic lines, dashed thin lines denote pilot lines, and dotted thin lines denote an electric drive/control system. Additionally, the drive system of FIG. 13 differs from the drive system of FIG. 11 in that the drive system of FIG. 13 uses a structure (serial system) in which an output axis of a pump electric motor 400, which is electrically driven through the inverter 18, is connected to the main pump 14 instated of the structure (parallel system) in which the two output axes of the engine 11 and the motor generator 12 are connected to the main pump 14 through the transmission 13. Other points of the present example are substantially the same as that of the drive system of FIG. 11, and descriptions thereof will be omitted.

The control method according to the embodiment of the present invention is applicable to the hybrid shovel having the above-mentioned structure.

Figure 14:
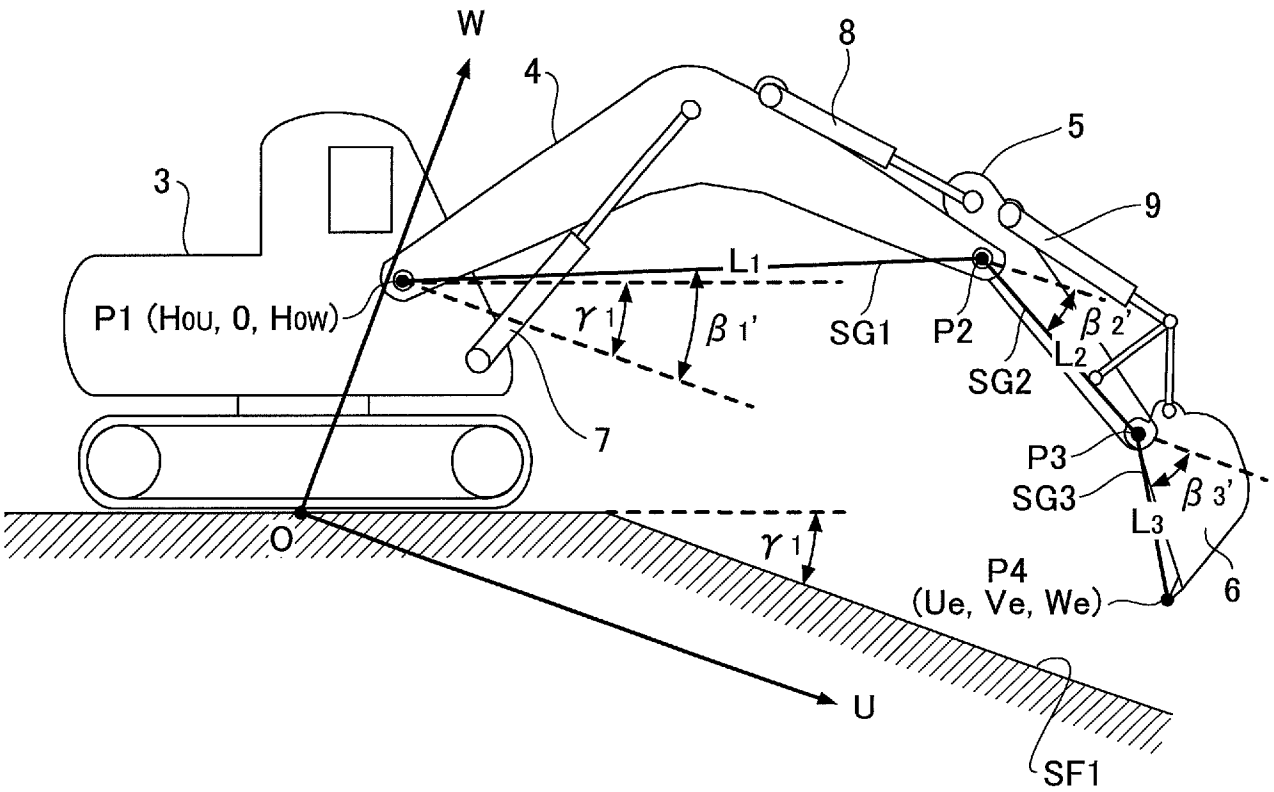
FIG. 14 is a side view of a shovel (part 1) for explaining a coordinate system used in a slope shaping mode.

Next a description is given, with reference to FIG. 14, of the slope shaping mode, which is an example of the automatic leveling mode. It should be noted that FIG. 14 is a diagram for explaining a coordinate system used in the slope shaping mode, and corresponds to FIG. 3A. Additionally, a lever setting for performing the slope shaping mode is the same as the lever setting for performing the automatic leveling mode illustrated in FIG. 5B. Moreover, FIG. 14 differs from FIG. 3A using the XYZ three-dimensional orthogonal coordinate system including the X-axis parallel to the horizontal plane and the Z-axis perpendicular to the horizontal plane in that FIG. 14 uses a UVW three-dimensional orthogonal coordinate system including a U-axis parallel to the slope plane and a W-axis perpendicular to the slope plane, but it is common in other points. It should be noted that a slope angle $\gamma_1$ can be set by an operator though a slope angle input part before executing the slope shaping mode. Additionally, FIG. 14 illustrates a case where the slope is formed in a negative direction in the W-axis direction, that is, it has a downhill grade viewed from the shovel.

Here, on the assumption that the three-dimensional coordinate (U, V, W) of the boom pin position P1 is set as (U, V, W)=($H_{0U}$, 0, $H_{0W}$) and the three-dimensional coordinate (U, V, W) of the bucket end position P4 is set as (U, V, W)=(Ue, Ve, We), Ue and We are represented by formulas (1)' and (2)', similar to the above-mentioned formulas (1) and (2). It should be noted that Ue and Ve represent a position of the end attachment on a UV-plane, and We represents a distance of the end attachment from the UV-plane.

$$Ue=H_{0U}+L_1 \cos \beta_1'+L_2 \cos \beta_2'+L_3 \cos \beta_3' \quad (1)'$$

$$We=H_{0W}+L_1 \sin \beta_1'+L_2 \sin \beta_2'+L_3 \sin \beta_3' \quad (2)'$$

It should be noted that Ve is equal to zero because the bucket end position P4 exists on the UW plane. Additionally, the angle $\beta_1'$ is an angle of the ground angle $\beta_1'$ added with the slope angle $\gamma_1$. Similarly, the angle $\beta_2'$ is an angle of the ground angle $\beta_2$ added with the slope angle $\gamma_2$, and the angle $\beta_3'$ is an angle of the ground angle $\beta_3$ added with the slope angle $\gamma_3$.

Moreover, on the assumption that the three-dimensional coordinate of the bucket pin position P3 is set as (U, V, W)=($U_{P3}$, $V_{P3}$, $W_{P3}$), $U_{P3}$ and $W_{P3}$ are represented by the formulas (6)' and (7)'.

$$U_{P3}=H_{0U}+L_1 \cos \beta_1'+L_2 \cos \beta_2' \quad (6)'$$

$$W_{P3}=H_{0W}+L_1 \sin \beta_1'+L_2 \sin \beta_2' \quad (7)'$$

In the slope shaping mode, when the lever 26B is tilted in a forward direction, at least one of the boom 4, arm 5 and bucket 6 moves so that the value Ue of the U coordinate is increased while the value Ve of the V coordinate and the value We of the W coordinate of the bucket end position P4 are maintained unchanged.

Moreover, in the slope shaping mode, when the lever 26B is tilted in a rearward direction, at least one of the boom 4, arm 5 and bucket 6 moves so that the value Ue of the U coordinate is decreased while the value Ve of the V coordinate and the value We of the W coordinate of the bucket end position P4 are maintained unchanged.

That is, the bucket end position P4 is moved in the U-axis direction in response to an operation of the lever 26B in the forward/rearward direction (corresponding to the X-direction operation of FIG. 5B, and hereinafter, referred to as the "U-direction operation"). Additionally, the bucket end position P4 is moved in the W-axis direction in response to an operation of the lever 26A in the forward/rearward direction (corresponding to the Z-direction operation of FIG. 5B, and hereinafter, referred to as the "W-direction operation"). It should be noted that the UVW three-dimensional orthogonal coordinate system and the XYZ three-dimensional orthogonal coordinate system may be combined and the controller 30 may be set to cause the bucket end position P4 to move in the U-axis direction in response to an operation of the lever 26B by an operator in a forward/rearward direction and cause the bucket end position P4 to move in the Z-axis direction in response to an operation of the lever 26A by the operator in a forward/rearward direction.

It should be noted that the operations of the levers 26A and 26B in a forward/rearward direction in the slope shaping mode, that is, a control performed in response to the W-direction operation and U-direction operation of the bucket 6 as an end attachment is referred to as the "slope position control". Additionally, a control performed in response to the operation of the lever 26A in a leftward/rightward direction and the operation of the lever 26B in a leftward/rightward direction in the slope shaping mode is the same as that of the automatic leveling mode.

As mentioned above, an operator can easily achieve a desired movement of the bucket along a slope by using the slope position control in the slope shaping mode, which is an example of the X-direction movement control (plane position control) in the automatic leveling mode.

Figure 15:
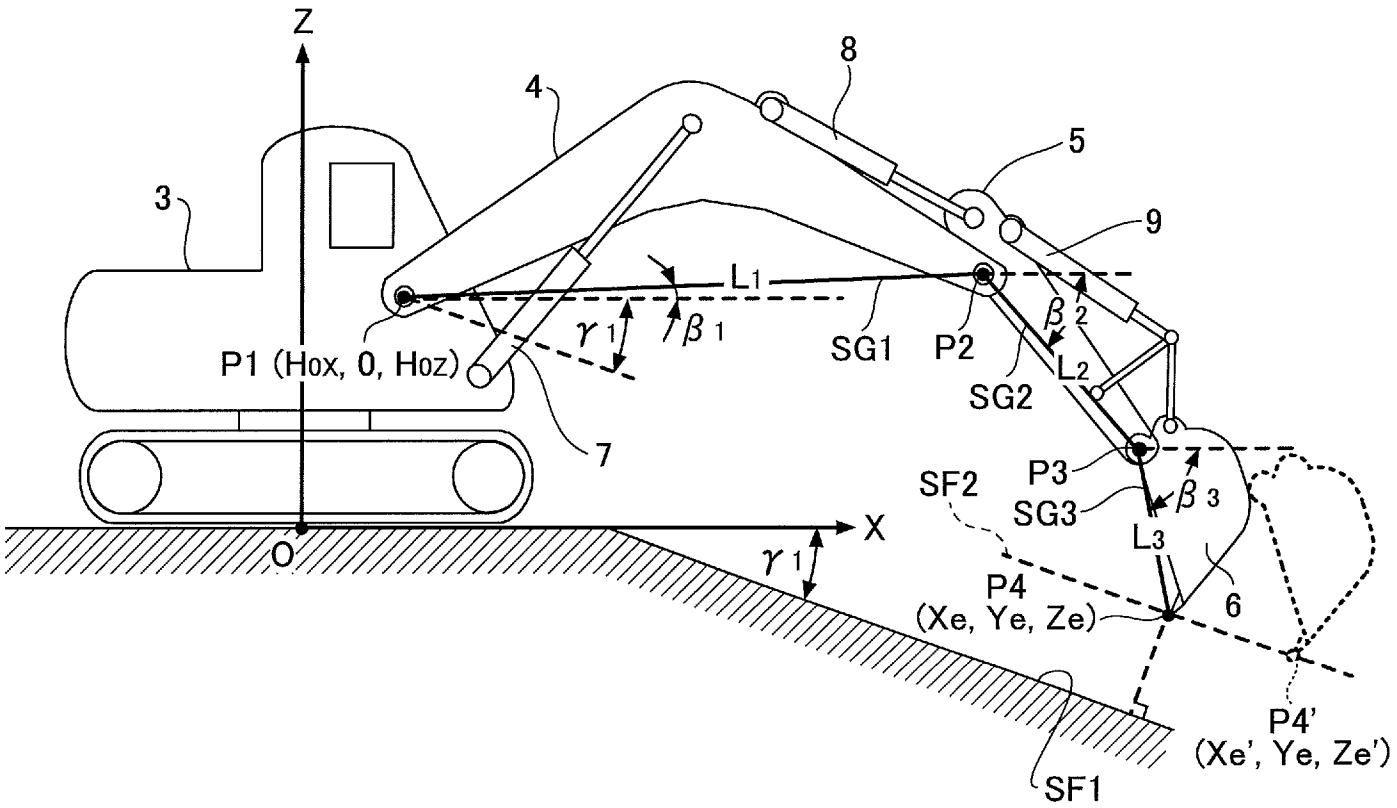
FIG. 15 is a side view of a shovel (part 2) for explaining the coordinate system used in the slope shaping mode.
Figure 16:
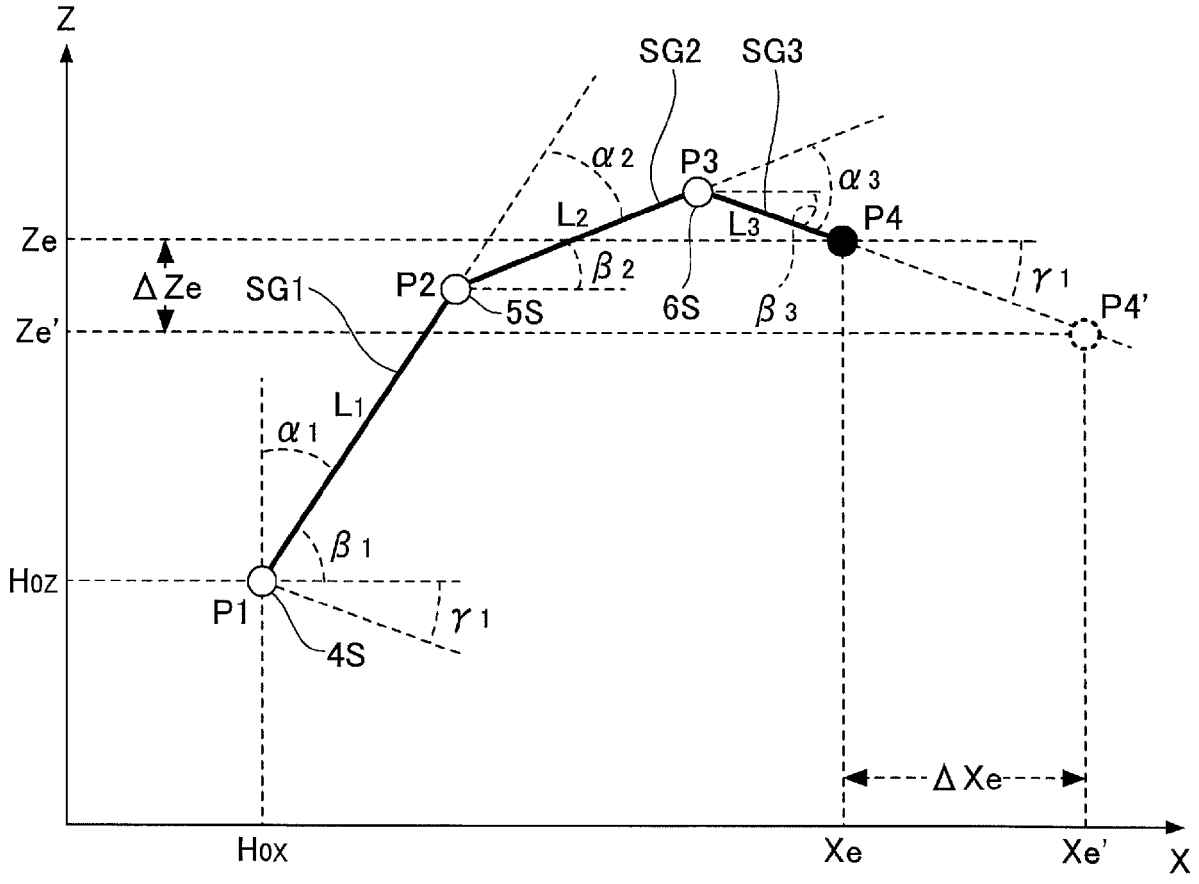
FIG. 16 is a diagram for explaining a movement of a front attachment in the slope shaping mode.

Next, a description is given, with reference to FIGS. 15 and 16, of another example of the slope shaping mode. FIG. 15 is a diagram for explaining a coordinate used in the slope shaping mode, and corresponds to FIG. 3A. FIG. 16 is a diagram for explaining a movement of the front attachment in the XZ-plane, and corresponds to FIG. 4. Additionally, a lever setting in the slope shaping mode is the same as the lever setting in the automatic leveling mode illustrated in FIG. 5B. Additionally, FIGS. 15 and 16 differ from FIG. 4 in that the slope angle $\gamma_1$ and the transition of the bucket end position P4 are illustrated, but they are common in other points. It should be noted that the slope angle $\gamma_1$ can be set by an operator before executing the slope shaping mode. Additionally, FIGS. 15 and 16 illustrate a case where the slope is formed in a negative direction in the X-axis directions, that is, the slope has a downhill grade when viewed from the shovel.

In the slope shaping mode, when the lever 26B is tilted in a forward direction, at least one of the boom 4, arm 5 and bucket 6 moves so that the value Xe of the X coordinate is increased while the value Ye of the Y coordinate is maintained unchanged and a distance between a slope SF1 of the angle $\gamma_1$ and the bucket end position P4 is maintained unchanged. That is, the bucket end position P4 moves in a direction perpendicular to the Y-axis and in a direction away from the shovel on a plane SF2 parallel to the slope SF1. In this respect, the value Ze of the Z-axis increases in a case where the slope has an uphill grade when viewed from the shovel, and decreases in a case where the slope has a downhill grade when viewed from the shovel. It should be noted that FIG. 15 illustrate the slope SF1 having a downhill grade when viewed from the shovel.

Moreover, in the slope shaping mode, when the lever 26B is tilted in a rearward direction, at least one of the boom 4, arm 5 and bucket 6 moves so that the value Xe of the X coordinate is decreased while the value Ye of the Y coordinate is maintained unchanged and the distance between the slope SF1 and the bucket end position P4 is maintained unchanged. That is, the bucket end position P4 moves in a direction perpendicular to the Y-axis and in a direction approaching the shovel on the plane SF2 parallel to the slope SF1. In this respect, the value Ze of the Z-axis decreases in a case where the slope has an uphill grade when viewed from the shovel, and increases in a case where the slope has a downhill grade when viewed from the shovel.

Here, on the assumption that the three-dimensional coordinate (X, Y, Z) of the bucket end position P4 is set as (X, Y, Z)=(Xe, Ye, Ze) and the three-dimensional coordinate (X, Y, Z) of the bucket end position P4' after movement is set as (X, Y, Z)=(Xe', Ye', Ze') and an amount of movement in the X-axis direction is set as ΔXe(=Xe'−Xe), an amount of movement ΔZe(=Ze'−Ze) is represent by the formula (8)

$$\Delta Ze=\Delta Xe \times \tan \gamma_1 \quad (8)$$

Moreover, in the slope shaping mode, a position control of the bucket pin position P3 may be performed instead of the position control of the bucket pin position P4. In this case, at least one of the boom 4, arm 5 and bucket 6 moves so that the value $X_{P3}$ of the X coordinate changes while the value $Y_{P3}$ of the Y coordinate of the bucket pin position P3 is maintained unchanged and a distance between the slope SF1 having the angle $\gamma_1$ and the bucket pin position P3 is maintained unchanged. That is, the bucket pin position P3 moves in a direction perpendicular to the Y-axis on a plane parallel to the slope SF1.

Here, on the assumption that the three-dimensional coordinate (X, Y, Z) of the bucket pin position P3 is set as (X, Y, Z)=($X_{P3}$, $Y_{P3}$, $Z_{P3}$) and the three-dimensional coordinate (X, Y, Z) of the bucket pin position P3' after movement is set as (X, Y, Z)=($X_{P3}'$, $Y_{P3}'$, $Z_{P3}'$) and an amount of movement in the X-axis direction is set as $\Delta X_{P3}(=X_{P3}'-X_{P3})$, an amount of movement $\Delta Z_{P3}(=Z_{P3}'-Z_{P3})$ is represent by the formula (9).

$$\Delta Z_{P3}=\Delta X_{P3}\times\tan\gamma_1 \quad (9)$$

It should be noted that in the present embodiment, the operation of the lever 26B in a forward/rearward direction in the slope shaping mode, that is, a control performed in response to the X-direction operation of the bucket 6 as an end attachment is referred to as the "slope position control". Additionally, a control performed in response to the operation of the lever 26A and the operation of the lever 26B in a leftward/rightward direction in the slope shaping mode is the same as that of the case of the automatic leveling mode.

Thus, an operator can easily achieve a desired movement of the bucket 6 along a slope by using the slope position control in the slope shaping mode, which is an example of the X-direction movement control (plane position control) in the automatic leveling mode.

Although the bucket 6 is used as an end attachment in the above-mentioned embodiments, a lifting magnet, a breaker, etc., may be used.

The present invention is not limited to the above-mentioned embodiments, and variations and modifications may be made without departing from the scope of the present invention.

What is claimed is:

1. A shovel, comprising:

a turning body;

an operating body including a boom attached to the turning body;

an arm attached to an end of the boom; and an end attachment attached to an end of the arm;

a first sensor configured to detect an angle of the boom;

a second sensor configured to detect an angle of the arm;

a third sensor configured to detect an angle of the end attachment;

a boom cylinder, an arm cylinder, and an end attachment cylinder configured to drive the boom, the arm, and the end attachment, respectively;

a control valve connected to each of the boom cylinder, the arm cylinder, and the end attachment cylinder to control a supply of operating oil to each of the boom cylinder, the arm cylinder, and the end attachment cylinder;

a hydraulic pump configured to supply the operating oil to the control valve;

a first lever and a second lever; and a controller, wherein the controller is configured to compute x and z coordinates (x, z) of the end attachment based on outputs of the first sensor, the second sensor, and the third sensor, move the end attachment in an x-axis direction while maintaining a height of the end attachment in a z-axis direction based on values of the computed x and z coordinates (x, z) and an operation of the first lever, and move the end attachment in the z-axis direction while maintaining a position of the end attachment in the x-axis direction based on the values of the computed x and z coordinates (x, z) and an operation of the second lever, and wherein the controller is configured to determine an amount of the operating oil to be supplied from the control valve to each of the boom cylinder, the arm cylinder, and the end attachment cylinder based on the operation of the first lever and the operation of the second lever, and determine a discharge amount of the operating oil to be discharged from the hydraulic pump to the control valve based on a total of the determined amounts of the operating oil to be supplied to the boom cylinder, the arm cylinder, and the end attachment cylinder.

2. A shovel, comprising:

a turning body;

an operating body including a boom attached to the turning body, an arm attached to an end of the boom, and an end attachment attached to an end of the arm;

a first sensor configured to detect an angle of the boom;

a second sensor configured to detect an angle of the arm;

a third sensor configured to detect an angle of the end attachment;

a boom cylinder, an arm cylinder, and an end attachment cylinder configured to drive the boom, the arm, and the end attachment, respectively;

a control valve connected to each of the boom cylinder, the arm cylinder, and the end attachment cylinder to control a supply of operating oil to each of the boom cylinder, the arm cylinder, and the end attachment cylinder;

a hydraulic pump configured to supply the operating oil to the control valve;

a first lever provided in a vertical position on one of a right side and a left side of a driver's seat and a second lever provided in a vertical position on the other of the right side and the left side of the driver's seat, wherein each of the first and second levers is configured to be tilted in a forward direction, a rearward direction, a rightward direction, and a leftward direction; and a controller, wherein the controller is configured to compute x and z coordinates (x, z) of the end attachment based on outputs of the first sensor, the second sensor, and the third sensor, perform a first operation to move the end attachment in an x-axis direction while maintaining a height of the end attachment in a z-axis direction, based on values of the computed x and z coordinates (x, z) and an operation of the first lever in the forward direction or the rearward direction, and perform a second operation to move the end attachment in the z-axis direction while maintaining a position of the end attachment in the x-axis direction, based on the values of the computed x and z coordinates (x, z) and an operation of the second lever in the forward direction or the rearward direction, and perform a third operation to turn the turning body based on an operation of one of the first lever and the second lever in the rightward direction or the leftward direction, and perform a fourth operation to control the angle of the end attachment based on an operation of the other of the first lever and the second lever in the rightward direction or the leftward direction, and wherein the first lever and the second lever are configured to be simultaneously operated to selectively perform two operations in combination among the first operation, the second operation, the third operation, and the fourth operation, and said selectively performing the two operations in combination includes simultaneously performing the first operation and the second operation in combination.

3. A shovel, comprising:

a turning body;

an operating body including a boom attached to the turning body;

an arm attached to an end of the boom; and an end attachment attached to an end of the arm;

a first sensor configured to detect an angle of the boom;

a second sensor configured to detect an angle of the arm;

a third sensor configured to detect an angle of the end attachment;

a boom cylinder, an arm cylinder, and an end attachment cylinder configured to drive the boom, the arm, and the end attachment, respectively;

a control valve connected to each of the boom cylinder, the arm cylinder, and the end attachment cylinder to control a supply of operating oil to each of the boom cylinder, the arm cylinder, and the end attachment cylinder;

a hydraulic pump configured to supply the operating oil to the control valve;

a first lever and a second lever; and a controller, wherein the controller is configured to compute x and z coordinates (x, z) of the end attachment based on outputs of the first sensor, the second sensor, and the third sensor, execute position control to change an x-coordinate position of the end attachment based on values of the computed x and z coordinates (x, z) and an operation of the first lever while fixing a z-coordinate position of the end attachment, and execute position control to change the z-coordinate position of the end attachment based on the values of the computed x and z coordinates and an operation of the second lever while fixing the x-coordinate position of the end attachment.

4. The shovel as claimed in claim 3, wherein the controller is configured to adjust an angle between said end attachment and a horizontal plane in response to another operation of the first lever or the second lever.

5. The shovel as claimed in claim 3, wherein the controller is configured to control turning of the turning body of the shovel independently in response to another operation of the first lever or the second lever.

6. The shovel as claimed in claim 3, wherein the controller is configured to perform feedback control on the operating body based on the outputs of the first sensor, the second sensor, and the third sensor attached to the operating body.

7. The shovel as claimed in claim 3, wherein the controller is configured to perform, in response to the operation of the first lever or the second lever, the position control to change the x-coordinate position of the end attachment or the position control to change the z-coordinate position of said end attachment with respect to a plane parallel to a slope having a set slope angle.

8. The shovel as claimed in claim 3, wherein the controller is configured to perform, in response to the operation of the first lever, the position control to change the x-coordinate position of said end attachment with respect to a plane parallel to a slope having a set slope angle, and perform, in response to the operation of the second lever, the position control to change the z-coordinate position of said end attachment with respect to a plane parallel to said slope or a plane parallel to a horizontal plane.

9. The shovel as claimed in claim 3, wherein the controller is configured to compute target x and z coordinates (x, z) of the end attachment to which the end attachment is to be moved, in accordance with the computed x and z coordinates (x, z) that are current x and z coordinates (x, z), an amount of the operation of the first lever, and an amount of the operation of the second lever, and generate a command value for each of the boom cylinder, the arm cylinder, and the end attachment cylinder to move the end attachment to the target x and z coordinates.

10. The shovel as claimed in claim 3, wherein the controller is configured to maintain the angle of said end attachment to a horizontal plane in a case of performing said position control to change the x-coordinate position of the end attachment or said position control to change the z-coordinate position of the end attachment.

* * * * *